US011654689B2

(12) United States Patent
Shinkawa

(10) Patent No.: US 11,654,689 B2
(45) Date of Patent: May 23, 2023

(54) LIQUID DISCHARGE DEVICE

(71) Applicant: SEIKO EPSON CORPORATION, Tokyo (JP)

(72) Inventor: Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 17/512,739

(22) Filed: Oct. 28, 2021

(65) Prior Publication Data

US 2022/0134767 A1 May 5, 2022

(30) Foreign Application Priority Data

Oct. 30, 2020 (JP) ..... JP2020-183187

(51) Int. Cl.
*B41J 2/175* (2006.01)

(52) U.S. Cl.
CPC ..... *B41J 2/17566* (2013.01); *B41J 2/17509* (2013.01)

(58) Field of Classification Search
CPC ..... B41J 2/17503; B41J 2/17509; B41J 2/17526; B41J 2/17566; B41J 2002/17579
See application file for complete search history.

(56) References Cited

U.S. PATENT DOCUMENTS

| | | | | |
|---|---|---|---|---|
| 5,289,211 | A * | 2/1994 | Morandotti | B41J 2/17566 73/304 R |
| 5,682,184 | A * | 10/1997 | Stephany | G01F 23/268 73/304 C |
| 6,337,959 | B1 | 1/2002 | Kwak et al. | |
| 9,079,414 | B2 * | 7/2015 | Lester | B41J 2/17553 |
| 10,752,010 | B2 * | 8/2020 | Tanaka | B41J 2/17509 |
| 2007/0216424 | A1 | 9/2007 | Sieh et al. | |
| 2009/0040262 | A1 | 2/2009 | Watanabe | |
| 2019/0240985 | A1 | 8/2019 | Ge et al. | |

FOREIGN PATENT DOCUMENTS

JP 2008-230227 A 10/2008

* cited by examiner

*Primary Examiner* — Anh T Vo
(74) *Attorney, Agent, or Firm* — Global IP Counselors, LLP

(57) ABSTRACT

A liquid discharge device includes a discharge section that discharges a liquid, a storage section that includes a first surface and a second surface separated from the first surface in a first direction, and is configured to store the liquid between the first surface and the second surface, a transmission electrode that is provided on the first surface, a reception electrode that is provided on the second surface, a filter circuit that removes a predetermined frequency component from an electric signal supplied from the reception electrode, and a detection circuit that detects a storage amount of the liquid stored in the storage section based on an output from the filter circuit.

9 Claims, 26 Drawing Sheets

FIG. 31

| | OUTPUT VOLTAGE $V_{out}$ | | | | | |
|---|---|---|---|---|---|---|
| | CASE 1 | CASE 2 | CASE 3 | CASE 4 | CASE 5 | CASE 6 |
| RECEPTION ELECTRODE 31 | H | H | H | L | L | L |
| RECEPTION ELECTRODE 32 | H | L | H | H/L | H | L |
| RECEPTION ELECTRODE 33 | H | H/L | L | H | L | L |
| ERROR DETERMINATION | NORMAL | ERROR | ERROR | NORMAL | ERROR | NORMAL |
| DETECTION RESULT OF STORAGE AMOUNT | EQUAL TO OR LARGER THAN FIRST AMOUNT | — | — | EQUAL TO OR LARGER THAN SECOND AMOUNT/ THIRD AMOUNT | — | LESS THAN THIRD AMOUNT |

FIG. 32

| | OUTPUT VOLTAGE $V_{out}$ | | | | | | | | |
|---|---|---|---|---|---|---|---|---|---|
| | CASE 1 | CASE 2 | CASE 3 | CASE 4 | CASE 5 | CASE 6 | CASE 7 | CASE 8 | CASE 9 |
| RECEPTION ELECTRODE 31 | L | H | L | L | H | L | H | L | H/L |
| RECEPTION ELECTRODE 32 | | | | | | | L | L | H |
| RECEPTION ELECTRODE 33 | | | | L | L | H | | | |
| RECEPTION ELECTRODE 34 | L | L | H | | | | | | |
| ERROR DETERMINATION | NORMAL | ERROR | NORMAL | NORMAL | ERROR | NORMAL | ERROR | NORMAL | NORMAL |
| DETECTION RESULT OF STORAGE AMOUNT | LESS THAN FOURTH AMOUNT | — | EQUAL TO OR LARGER THAN FOURTH AMOUNT | LESS THAN FOURTH AMOUNT | — | EQUAL TO OR LARGER THAN THIRD AMOUNT/ FOURTH AMOUNT | — | LESS THAN FOURTH AMOUNT | EQUAL TO OR LARGER THAN FIRST AMOUNT/ EQUAL TO OR LESS THAN SECOND AMOUNT |

LIQUID DISCHARGE DEVICE

The present application is based on, and claims priority from JP Application Serial Number 2020-183187, filed Oct. 30, 2020, the disclosure of which is hereby incorporated by reference herein in its entirety.

BACKGROUND

1. Technical Field

The present disclosure relates to a liquid discharge device.

2. Related Art

A residual quantity sensing sensor that detects a residual quantity of contents of a container is known (for example, JP-A-2008-230227). The residual quantity sensing sensor includes a detection electrode disposed to face the container and a guard electrode disposed to face the detection electrode to be coupled to a reference potential, in which the residual quantity of the contents of the container is detected based on electrostatic capacitance measured by the detection electrode.

In a technique described in JP-A-2008-230227, when a liquid level of the contents of the container fluctuates, electrostatic capacitance changes, so that there is a problem in that the liquid level cannot be detected accurately.

SUMMARY

According to an aspect of the present disclosure, there is provided a liquid discharge device including a discharge section that discharges a liquid, a storage section that includes a first surface and a second surface separated from the first surface in a first direction, and is configured to store the liquid between the first surface and the second surface, a transmission electrode that is provided on the first surface, a reception electrode that is provided on the second surface, a filter circuit that removes a predetermined frequency component from an electric signal supplied from the reception electrode, and a detection circuit that detects a storage amount of the liquid stored in the storage section based on an output from the filter circuit.

BRIEF DESCRIPTION OF THE DRAWINGS

FIG. 31 is a table showing a relationship between an output voltage and a detection result.

FIG. 32 is a table showing the relationship between the output voltage and the detection result.

DESCRIPTION OF EXEMPLARY EMBODIMENTS

Hereinafter, embodiments for carrying out the present disclosure will be described with reference to the accompanying drawings. However, in each drawing, a dimension and a scale of each section are appropriately different from actual ones. Further, since the embodiments which will be described below are suitable specific examples of the present disclosure, various technically preferable limitations are attached. However, the scope of the present disclosure is not limited to the embodiments unless the following description dos not particularly limit the present disclosure.

Figure 1:
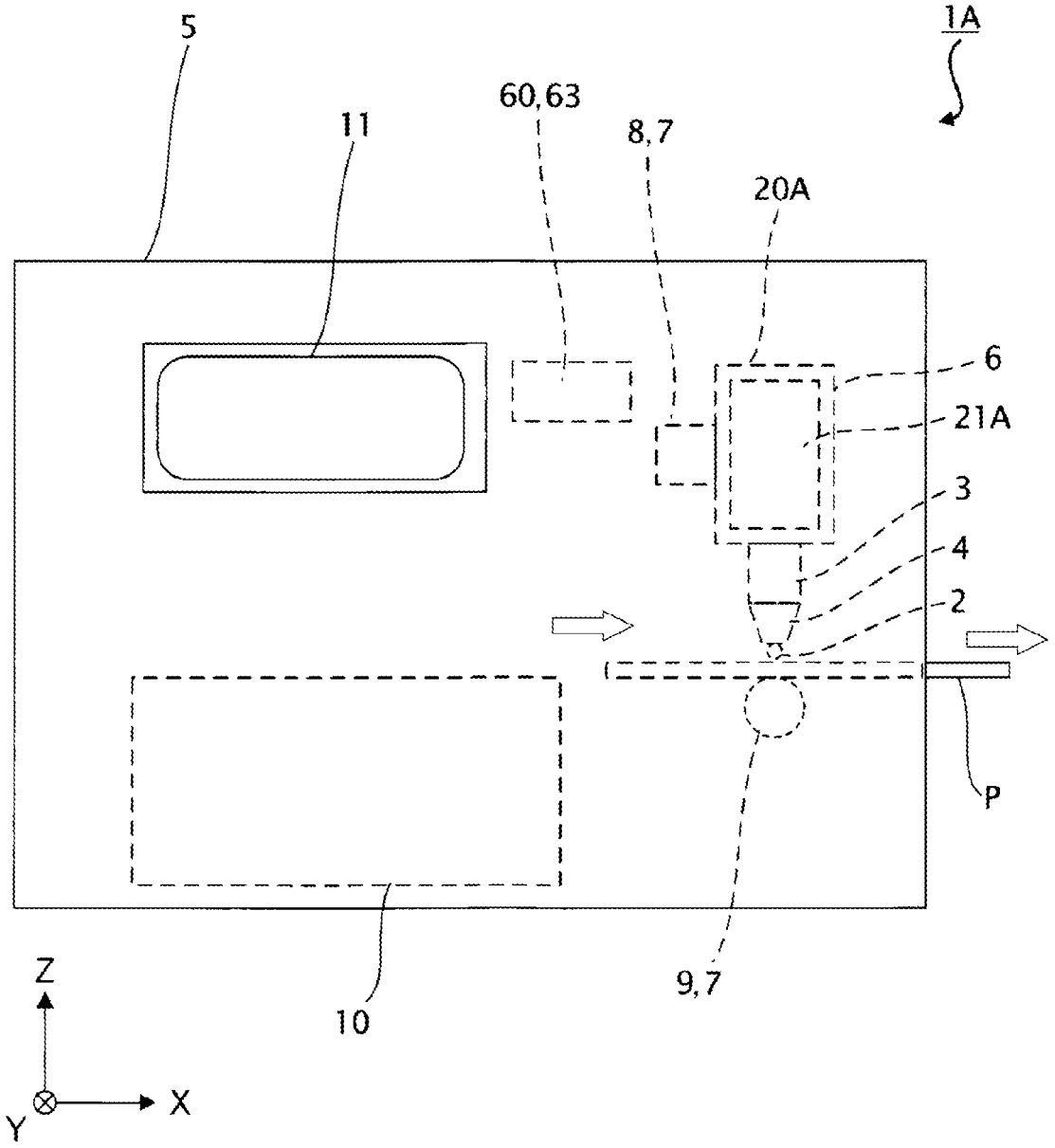
FIG. 1 is a schematic diagram of a liquid discharge device according to a first embodiment.

FIG. 1 is a schematic diagram of a liquid discharge device 1A including a storage amount detection device 20A. The liquid discharge device 1A is an ink jet printer that discharges ink 2 to form an image on recording paper P. The ink 2 is an example of a "liquid", and the recording paper P is an example of a "medium". The storage amount detection device 20A detects the storage amount of the ink 2 stored in the storage section 21A.

Print data indicating an image to be formed by the liquid discharge device 1A is supplied to the liquid discharge device 1A from a host computer such as a personal computer or a digital camera. The liquid discharge device 1A executes a printing process of forming the image, which is indicated by the print data supplied from the host computer, on the recording paper P.

The liquid discharge device 1A is a serial printer. Specifically, when executing the printing process, the liquid discharge device 1A transports the recording paper P in a sub scanning direction and discharges the ink 2 from the discharge section 4 while reciprocating a head unit 3 toward a main scanning direction that intersects the sub scanning direction, thereby forming dots corresponding to the print data on the recording paper P.

In FIG. 1, an X-axis direction, a Y-axis direction, and a Z-axis direction are shown. The X-axis direction is a direction along the sub scanning direction. The Y-axis direction is a direction along the main scanning direction. The Z-axis direction is a direction along a height direction. The Y-axis direction is an example of a first direction that intersects the height direction.

The liquid discharge device 1A includes a housing 5, a carriage 6, and a transport unit 7. When the printing process is executed, the transport unit 7 reciprocates the carriage 6 in the Y-axis direction and transports the recording paper P in the X-axis direction to change a relative position of the recording paper P with respect to the head unit 3, so that the ink 2 can land on the entire recording paper P. The transport unit 7 includes a carriage transport mechanism 8 for reciprocating the carriage 6 and a medium transport mechanism 9 for transporting the recording paper P.

The liquid discharge device 1A includes a medium storage section 10 that stores the recording paper P. The recording paper P is supplied from the medium storage section 10 to the medium transport mechanism 9 and is transported to the vicinity of the head unit 3.

The liquid discharge device 1A includes a notification section 11. The notification section 11 includes a liquid crystal display device. The notification section 11 may be configured to provide a notification by voice, may be configured to provide a notification by vibration, or may be configured to provide a notification by a blinking pattern of a lamp. A screen of a personal computer or a device, such as a smartphone, having a communication function may function as the notification section. The notification section 11 displays a detection result by a detection circuit 63 which will be described later. The notification section 11 can display other information.

Figure 2:
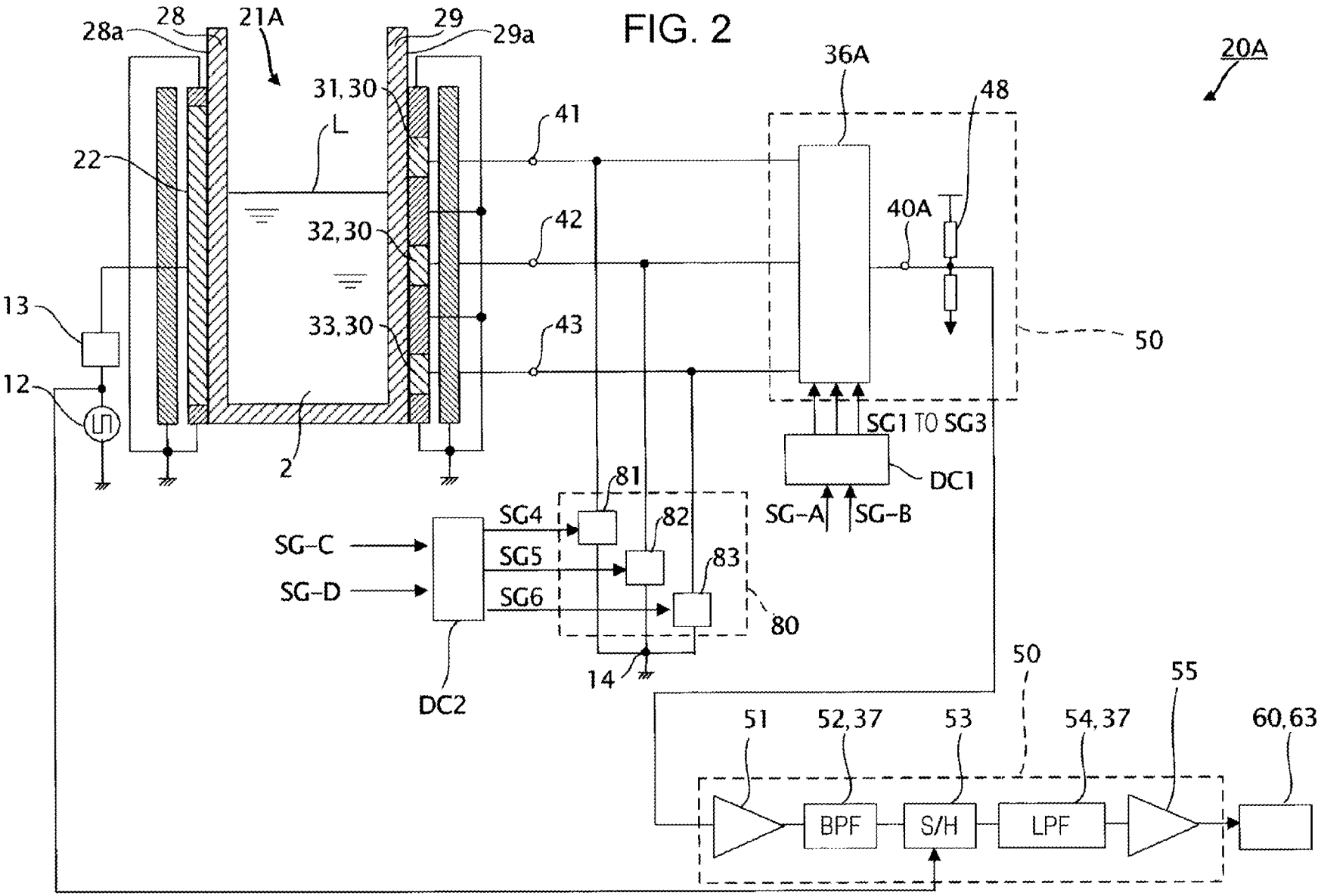
FIG. 2 is a schematic diagram of a storage amount detection device according to the first embodiment.
Figure 3:
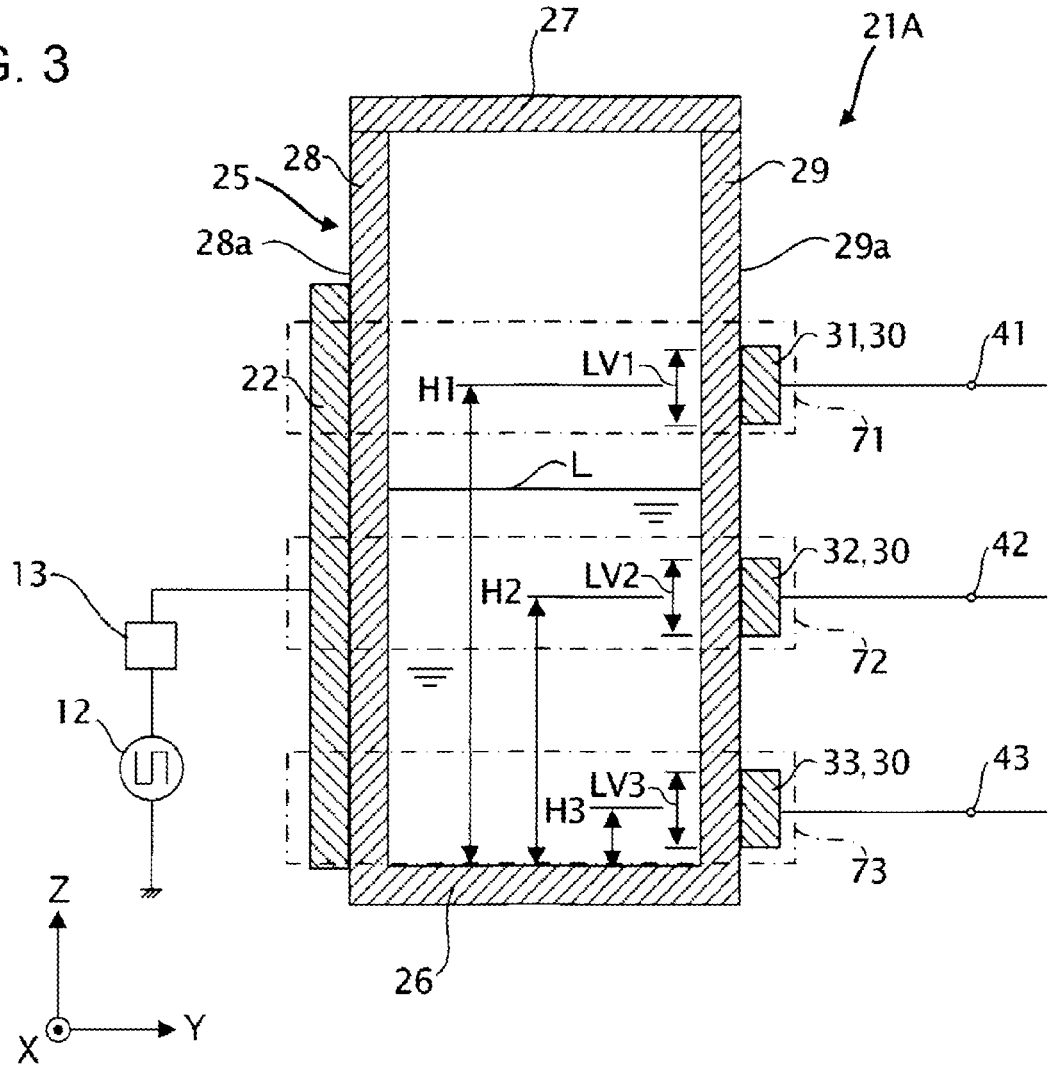
FIG. 3 is a cross-sectional diagram of a storage section.

FIG. 2 is a schematic diagram of the storage amount detection device 20A. FIG. 3 is a cross-sectional diagram of the storage section 21A. As shown in FIG. 2, the storage amount detection device 20A includes a storage section 21A, a transmission electrode 22, a reception electrode 30, a detection section 50, and a control section 60. The control section 60 serves as the control section for each section of the liquid discharge device 1A.

As shown in FIG. 3, the storage section 21A includes a cylindrical body 25, a bottom plate 26, and a top plate 27. The cylindrical body 25 includes a side plate 28 and a side plate 29 that are separated from each other in the Y-axis direction. The cylindrical body 25 includes a plurality of side plates (not shown) that are separated from each other in the X-axis direction. The bottom plate 26 is disposed to close an opening at the bottom of the cylindrical body 25. The top plate 27 closes an opening at the top of the cylindrical body 25. A space inside the cylindrical body 25 is a space that accommodates the liquid.

A constituent material of the storage section 21A is not particularly limited as long as the constituent material does not transmit the ink 2 and is composed of a dielectric, and, for example, various resin materials, such as polyolefin, polycarbonate, polyester, and various glass materials can be used. Further, the storage section 21A may be hard or soft, and a part thereof may be hard and a remaining part may be soft.

An outlet (not shown) is formed on the bottom plate 26. The liquid stored in the storage section 21A is discharged through the outlet. The outlet communicates with a discharge section 4 of the head unit 3. When the ink 2 is discharged from the head unit 3, the storage amount of the ink 2 stored in the storage section 21A decreases, and a liquid level L decreases. The storage amount detection device 20A can detect the liquid level L of the ink 2 to grasp a residual quantity of the ink 2. The notification section 11 provides a notification to a user by displaying the residual quantity of the ink 2, thereby preventing the ink 2 from running out at an undesired timing.

A transmission electrode 22 is provided on an outer surface 28*a* of the side plate 28 of the storage section 21A. The outer surface 28*a* of the side plate 28 is an example of a first surface of the storage section 21A. The reception electrode 30 is provided on an outer surface 29*a* of the side plate 29 of the storage section 21A. The outer surface 29*a* of the side plate 29 is an example of a second surface of the storage section 21A. The first surface and the second surface of the storage section may be separated in the X-axis direction, may be separated in the Y-axis direction, or may be separated in the other directions.

The reception electrode 30 includes reception electrodes 31 to 33. The reception electrode 31 is an example of a first reception electrode. The reception electrode 32 is an example of a second reception electrode. The reception electrode 33 is an example of a third reception electrode.

The transmission electrode 22 and the reception electrodes 31 to 33 are made of a conductive material, for example, a metal material such as gold, silver, copper, aluminum, iron, nickel, cobalt, or an alloy containing the materials. The transmission electrode 22 and the reception electrodes 31 to 33 may be formed directly on the outer surfaces of the side plates 28 and 29 by, for example, plating, vapor deposition, printing, or the like, may be attached to the outer surfaces of the side plates 28 and 29 via an adhesive layer (not shown), or may be supported by a support member (not shown) in contact or non-contact with the side plates 28 and 29.

The reception electrodes 31 to 33 are disposed at positions that overlap the transmission electrode 22 when viewed from the X-axis direction. The reception electrodes 31 to 33 are disposed at different positions from each other in the height direction. The reception electrode 31 is disposed at a position higher than the positions of the reception electrodes 32 and 33, and the reception electrode 32 is disposed at a position higher than the position of the reception electrode 33. The reception electrode 31 may be disposed at a lower position than the reception electrodes 32 and 33, and the reception electrode 32 may be disposed at a lower position than the reception electrode 33. The "height direction" is a direction along a vertical direction in a normal use state of the liquid discharge device 1A.

The reception electrode 31 is disposed at a height position H1. The height position H1 is an example of a first height position. For example, in the height direction, a central position of the reception electrode 31 is disposed at the height position H1. A lower end of the reception electrode 31 may be disposed at the height position H1, and the other part of the reception electrode 31 may be disposed at the height position H1.

The reception electrode 32 is disposed at a height position H2. The height position H2 is an example of a second height position. For example, in the height direction, a central position of the reception electrode 32 is disposed at the height position H2. A lower end of the reception electrode 32 may be disposed at the height position H2, and the other part of the reception electrode 32 may be disposed at the height position H2.

The reception electrode 33 is disposed at a height position H3. The height position H3 is an example of a third height position. For example, in the height direction, a central position of the reception electrode 33 is disposed at the height position H3. A lower end of the reception electrode 33 may be disposed at the height position H3, and the other part of the reception electrode 33 may be disposed at the height position H3.

The transmission electrode 22 and the reception electrode 31 form a parallel flat plate, and compose a capacitor 71. The transmission electrode 22 and the reception electrode 32 form a parallel flat plate, and compose a capacitor 72. The transmission electrode 22 and the reception electrode 33 form a parallel flat plate, and compose a capacitor 73. The capacitors 71 to 73 may have the same structure or different structures.

Electrostatic capacitance C [F] of the capacitors 71 to 73 is expressed by the following Equation (1).

$$C=\varepsilon_0\varepsilon_1 S/d \quad (1)$$

$\varepsilon_0$ is a permittivity of vacuum. $\varepsilon_1$ is a relative permittivity due to an object existing between the electrodes of the capacitors 71 to 73. The electrostatic capacitance C of the capacitors 71 to 73 differs depending on the relative permittivity $\varepsilon_1$ of the object existing between the electrodes of the capacitors 71 to 73. The relative permittivity $\varepsilon_1$ changes depending on a ratio of the ink 2 and air existing between the electrodes of the capacitors 71 to 73. A relative permittivity $\varepsilon_{ink}$ of the ink 2 is larger than a relative permittivity of $\varepsilon_{air}$. The relative permittivity $\varepsilon_{ink}$ of the ink 2 is, for example, 80, and the relative permittivity $\varepsilon_{air}$ of air is almost 0.

Figure 4:
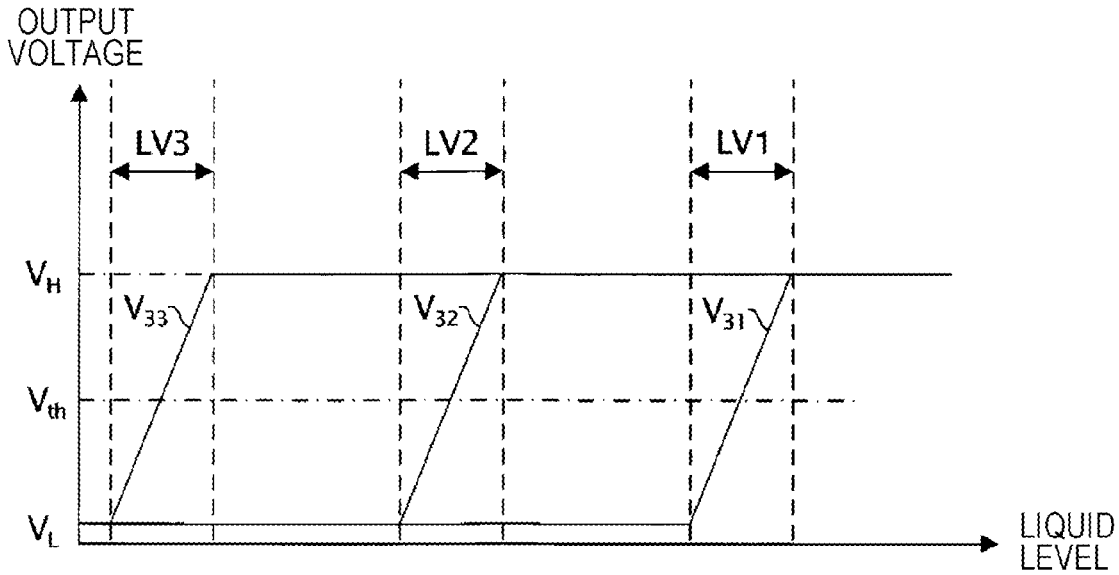
FIG. 4 is a graph showing a relationship between a liquid level and an output voltage from a capacitor.

An AC power supply 12 is electrically coupled to the transmission electrode 22. The AC power supply 12 outputs, for example, a pulse wave of 3.3 [V] as a transmission signal to the transmission electrode 22. FIG. 4 is a graph showing a relationship between the liquid level of the ink 2 and output voltages of the capacitors 71 to 73. A horizontal axis indicates the liquid level of the ink 2, and indicates that the liquid level is higher on a right side in the drawing. A vertical axis indicates the output voltage [V] of the capacitor, and indicates that the voltage is higher on an upper side in the drawing.

A liquid level range LV1 is a range from a lower end to an upper end of the capacitor 71 in the height direction. A liquid level range LV2 is a range from a lower end to an upper end of the capacitor 72 in the height direction. A liquid level range LV3 is a range from a lower end to an upper end of the capacitor 73 in the height direction. The liquid level range LV1 is set to the highest position, and the liquid level range LV2 and the liquid level range LV3 become lower positions in this order.

When air exists between the electrodes of the capacitors 71 to 73 and the ink 2 does not exist, the output voltage $V_{out}$ from the capacitors 71 to 73 is $V_L$ [V]. The output voltage $V_{out}$ increases as a ratio of the ink 2 which exists between the electrodes of the capacitors 71 to 73 increases. When a space between the electrodes of the capacitors 71 to 73 is filled with the ink 2 and air does not exist, the output voltage $V_{out}$ is $V_H$ [V]. For example, when the output voltage $V_{out}$ becomes a predetermined threshold value $V_{th}$, it can be regarded that the liquid level L of the ink 2 exists between the liquid level ranges LV1 to LV3 including the height positions H1 to H3 in which the capacitors 71 to 73 are disposed. The threshold value $V_{th}$ is a value which is equal to or larger than $V_L$ and is equal to or less than $V_H$. For example, when $V_L$ is 0 [%] and $V_H$ is 100 [%], the threshold value $V_{th}$ may be a value of 50%, a value of 30%, or a value of 70%, or another value.

When an output voltage $V_{31}$ from the capacitor 71 is the threshold value $V_{th}$, the liquid level L of the ink 2 exists in the liquid level range LV1. When an output voltage $V_{32}$ from the capacitor 72 is the threshold value $V_{th}$, the liquid level L of the ink 2 exists in the liquid level range LV2. When an output voltage $V_{33}$ from the capacitor 73 is the threshold value $V_{th}$, the liquid level L of the ink 2 exists in the liquid level range LV3.

Figure 5:
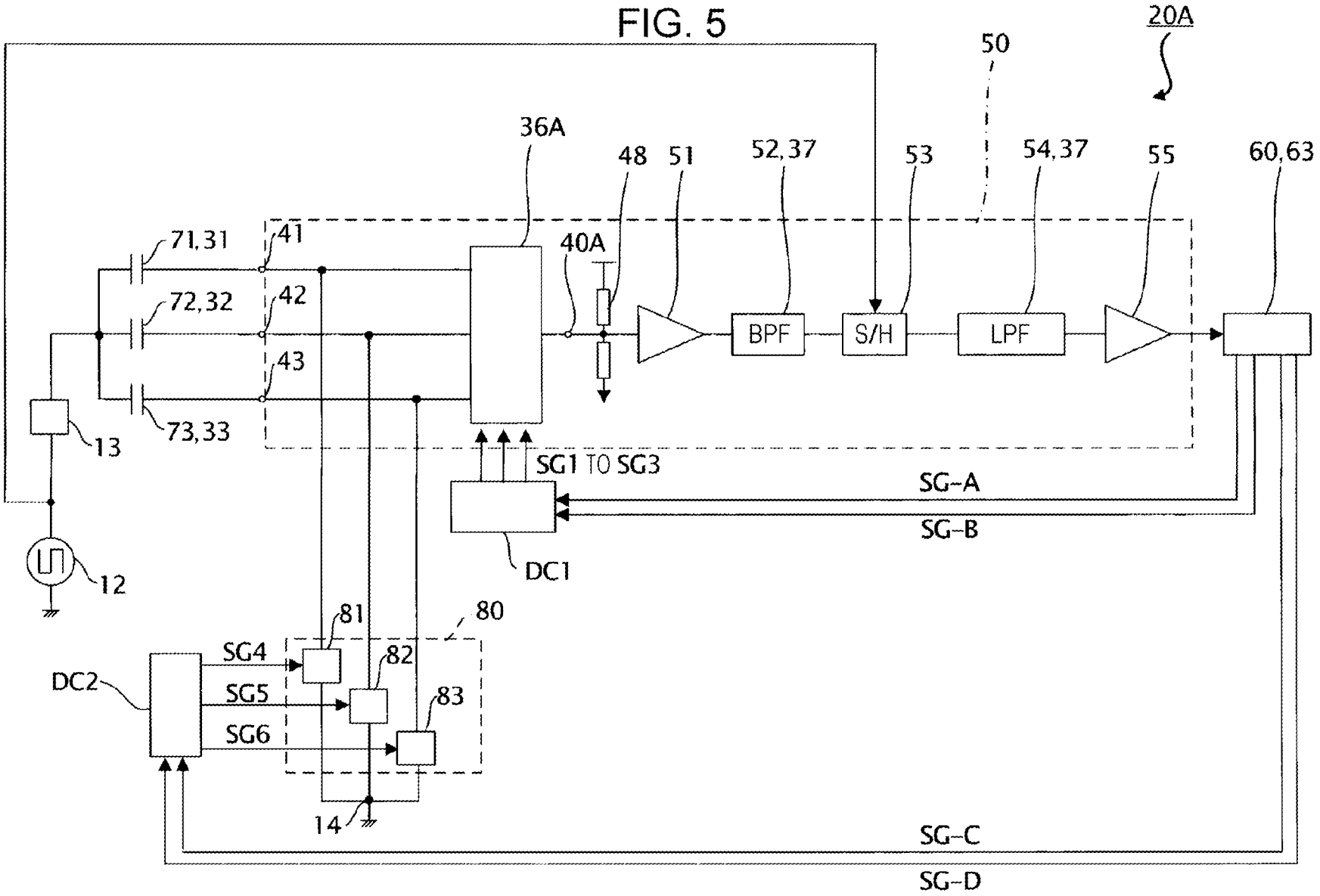
FIG. 5 is a circuit diagram of the storage amount detection device.
Figure 6:
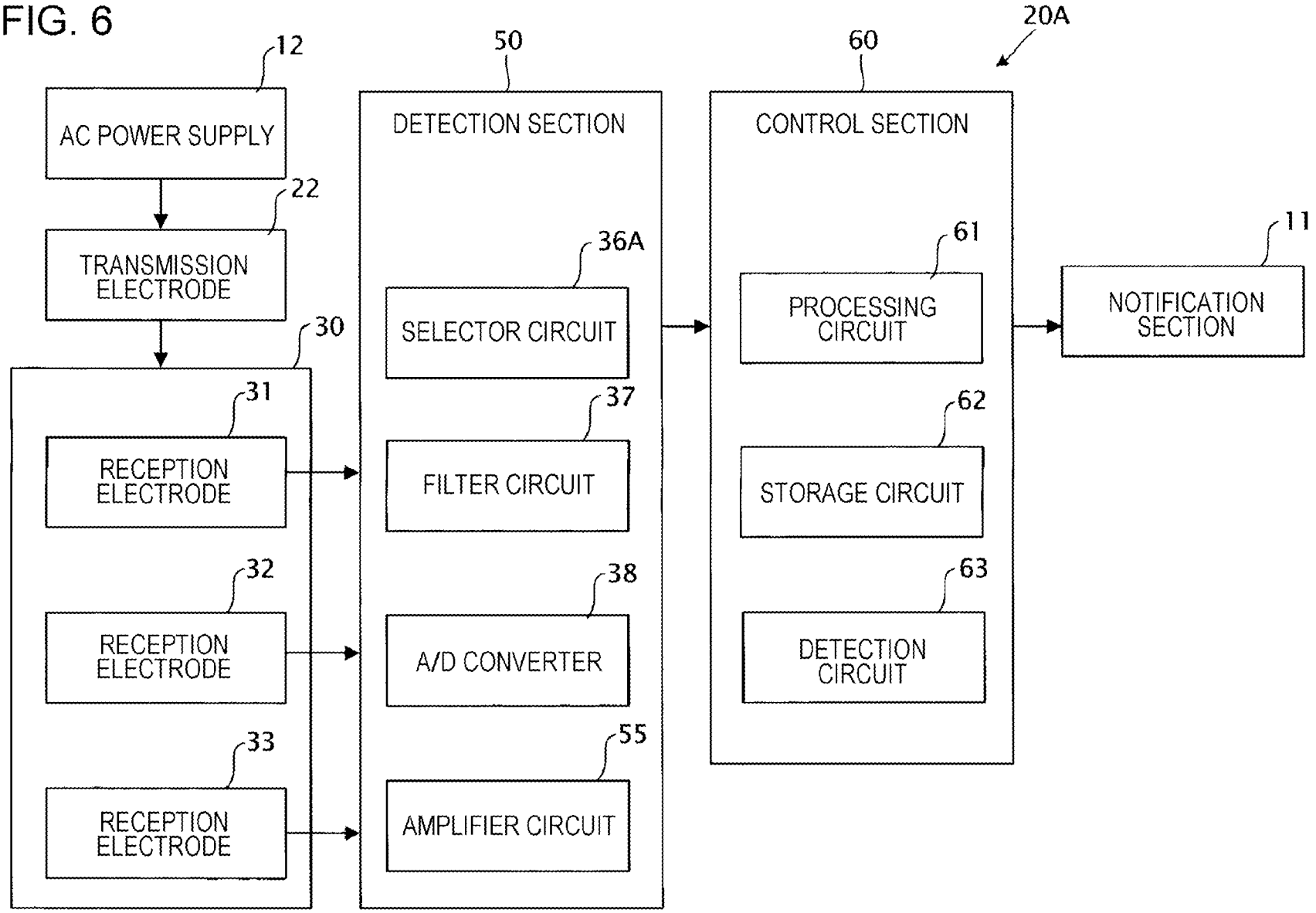
FIG. 6 is a block diagram of the storage amount detection device.

Next, the detection section 50 will be described. FIG. 5 is a circuit diagram of the storage amount detection device 20A. FIG. 6 is a block diagram of the storage amount detection device 20A. As shown in FIG. 5, the detection section 50 includes a selector circuit 36A, a buffer circuit 51, a BPF 52, an S/H 53, an LPF 54, and an amplifier circuit 55. The detection section 50 includes a filter circuit 37 that removes a predetermined frequency component from an input electric signal. The detection section 50 includes the BPF 52 and the LPF 54 as the filter circuit 37.

The selector circuit 36A is electrically coupled to input terminals 41 to 43 and an output terminal 40A. The input terminal 41 is an example of a first input terminal. The input terminal 42 is an example of a second input terminal. The input terminal 43 is an example of a third input terminal. The input terminal 41 is electrically coupled to the reception electrode 31. The input terminal 42 is electrically coupled to the reception electrode 32. The input terminal 43 is electrically coupled to the reception electrode 33.

The selector circuit 36A switches whether or not to electrically couple the output terminal 40A to at least one of the input terminals 41 to 43. The output terminal 40A is electrically coupled to at least one of the input terminals 41 to 43. The selector circuit 36A electrically couples the reception electrode 31 to the output terminal 40A by electrically coupling the input terminal 41 to the output terminal 40A. The selector circuit 36A electrically couples the reception electrode 32 to the output terminal 40A by electrically coupling the input terminal 42 to the output terminal 40A. The selector circuit 36A electrically couples the reception electrode 33 to the output terminal 40A by electrically coupling the input terminal 43 to the output terminal 40A. In this way, the selector circuit 36A switches whether or not to electrically couple at least one of the reception electrodes 31 to 33. A bias circuit 48 is electrically coupled to a subsequent stage of the selector circuit 36A.

The buffer circuit 51 is electrically coupled to the subsequent stage of the selector circuit 36A. The buffer circuit 51 is electrically coupled to the output terminal 40A of the selector circuit 36A. Since the impedances of the reception electrodes 31 to 33 are high, the buffer circuit 51 performs impedance conversion.

The BPF 52 includes a bandpass filter circuit. The BPF 52 is electrically coupled to a subsequent stage of the buffer circuit 51. The BPF 52 passes a frequency component of a predetermined band in the input electric signal, and removes frequency components of the other bands.

The S/H 53 includes a sample hold circuit. The S/H 53 is electrically coupled to a subsequent stage of the BPF 52. An electric signal output from the BPF 52 is input to the S/H 53. The S/H 53 samples the electric signal for each predetermined cycle and holds the electric signal at a constant value until an operation of A/D conversion ends. Further, the S/H 53 is electrically coupled to the AC power supply 12. A pulse wave of 3.3 V is input to the S/H 53 from the AC power supply 12.

The LPF 54 includes a low-pass filter circuit. The LPF 54 is electrically coupled to a subsequent stage of the S/H 53. An electric signal output from the S/H 53 is input to the LPF 54. The LPF 54 removes a high frequency component from the input electric signal. The noise contained in the high frequency component is removed by the LPF54.

The amplifier circuit 55 is electrically coupled to a subsequent stage of the LPF 54. An electric signal output from the LPF 54 is input to the amplifier circuit 55. The amplifier circuit 55 amplifies the input electric signal. The amplified electric signal is input to the control section 60 in a subsequent stage.

The detection section 50 includes an A/D converter 38. The A/D converter 38 converts an analog electric signal, which is the input electric signal, into a digital electric signal. The analog electric signal input to the A/D converter 38 is converted into the digital electric signal and is output. The A/D converter 38 is coupled to a subsequent stage of the amplifier circuit 55. The digital electric signal output from the A/D converter 38 is input to the control section 60.

Next, the control section 60 will be described. As shown in FIG. 6, the control section 60 includes, for example, a processing circuit 61, such as a Central Processing Unit (CPU) or a Field Programmable Gate Array (FPGA), and a storage circuit 62 such as a semiconductor memory. The storage circuit 62 stores a control program and various parameters used to calculate the storage amount of the ink 2. Further, the storage circuit 62 functions as a work area of the processing circuit 61. The processing circuit 61 reads the control program from the storage circuit 62. The processing circuit 61 functions as a control center of the liquid discharge device 1A by executing the read control program.

The control section 60 includes the detection circuit 63. The detection circuit 63 detects the storage amount of the ink 2 in the storage section 21A based on the output from the output terminal 40A. The detection circuit 63 detects the storage amount of the ink 2 based on a determination result based on the output from the output terminal 40A in a state in which the output terminal 40A and the reception electrode 31 are coupled to each other, a determination result based on the output from the output terminal 40A in a state in which the output terminal 40A and the reception electrode 32 are coupled to each other, and a determination result based on the output from the output terminal 40A in a state in which the output terminal 40A and the reception electrode 33 are coupled to each other. The detection result of the storage amount of the ink 2 by the detection circuit 63 will be described later with reference to FIG. 31.

Next, the determination result based on the output from the output terminal 40A in the state in which the output terminal 40A and the reception electrode 31 are coupled to each other will be described. The detection circuit 63 determines whether or not the storage amount of the ink 2 is equal to or larger than a first amount based on the electric signal output from the output terminal 40A in the state in which the reception electrode 31 is coupled. When an output voltage $V_{31}$ of the capacitor 71 exceeds the threshold value $V_{th}$, the detection circuit 63 determines that the liquid level L is equal to or higher than the height position H1 and the storage amount of the ink 2 is equal to or larger than the first amount. When the liquid level L is equal to or higher than the height position H1, the detection circuit 63 determines that the storage amount is equal to or larger than the first amount. When the liquid level L is less than the height position H1, the detection circuit 63 determines that the storage amount is less than the first amount. When the height position of the liquid level L of the ink 2 is detected, the storage amount of the ink 2 can be detected. The detection circuit 63 may arbitrarily set the height position of the liquid level L according to a value of the threshold value $V_{th}$. When the output voltage $V_{31}$ exceeds the threshold value $V_{th}$, the detection circuit 63 may determine that the storage amount of the ink 2 is the first amount.

Next, the determination result based on the output from the output terminal 40A in the state in which the output terminal 40A and the reception electrode 32 are coupled to each other will be described. The detection circuit 63 determines whether or not the storage amount of the ink 2 is equal to or larger than a second amount based on the output from the output terminal 40A in the state in which the reception electrode 32 is coupled. When the output voltage $V_{32}$ of the capacitor 72 exceeds the threshold value $V_{th}$, the detection circuit 63 determines that the liquid level L is equal to or higher than the height position H2 and the storage amount of the ink 2 is equal to or larger than the second amount. When the liquid level L is equal to or higher than the height position H2, the detection circuit 63 determines that the storage amount is equal to or larger than the second amount. When the liquid level L is less than the height position H2, the detection circuit 63 determines that the storage amount is less than the second amount.

Next, the determination result based on the output from the output terminal 40A in the state in which the output terminal 40A and the reception electrode 33 are coupled to each other will be described. The detection circuit 63 determines whether or not the storage amount of the ink 2 is equal to or larger than a third amount based on the output from the output terminal 40A in the state in which the reception electrode 33 is coupled. When the output voltage $V_{33}$ of the capacitor 73 exceeds the threshold value $V_{th}$, the detection circuit 63 determines that the liquid level L is equal to or higher than the height position H3, and the storage amount of the ink 2 is equal to or larger than the third amount. When the liquid level L is equal to or higher than the height position H3, the detection circuit 63 determines that the storage amount is equal to or larger than the third amount. When the liquid level L is less than the height position H3, the detection circuit 63 determines that the storage amount is less than the third amount.

Next, a case where the detection result of the storage amount becomes an error will be described. For example, when the determination result based on the output from the output terminal 40A includes an error, the detection result of the storage amount based on the determination result becomes an error. The detection circuit 63 determines that the detection result of the storage amount is error when it is determined that the storage amount of ink 2 is equal to or larger than the first amount based on the output from the output terminal 40A in the state in which the reception electrode 31 is coupled and when it is determined that the storage amount of the ink 2 is less than the third amount based on the output from the output terminal 40A in the state in which the reception electrode 32 is coupled.

The detection circuit 63 determines that the detection result of the storage amount is error when it is determined that the storage amount of the ink 2 is less than the first amount based on the electric signal output from the output terminal 40A in the state in which the reception electrode 31 is coupled, when it is determined that the storage amount of the ink 2 is equal to or larger than the second amount based on the electric signal output from the output terminal 40A in the state in which the reception electrode 32 is coupled, and when it is determined that the storage amount of the ink 2 is less than the third amount based on the electric signal output from the output terminal 40A in the state in which the reception electrode 33 is coupled.

The notification section 11 is electrically coupled to the control section 60 and displays the detection result by the detection circuit 63. The notification section 11 displays the storage amount of the ink 2. The notification section 11 displays an error message indicating that the detection result of the storage amount is error.

Figure 7:
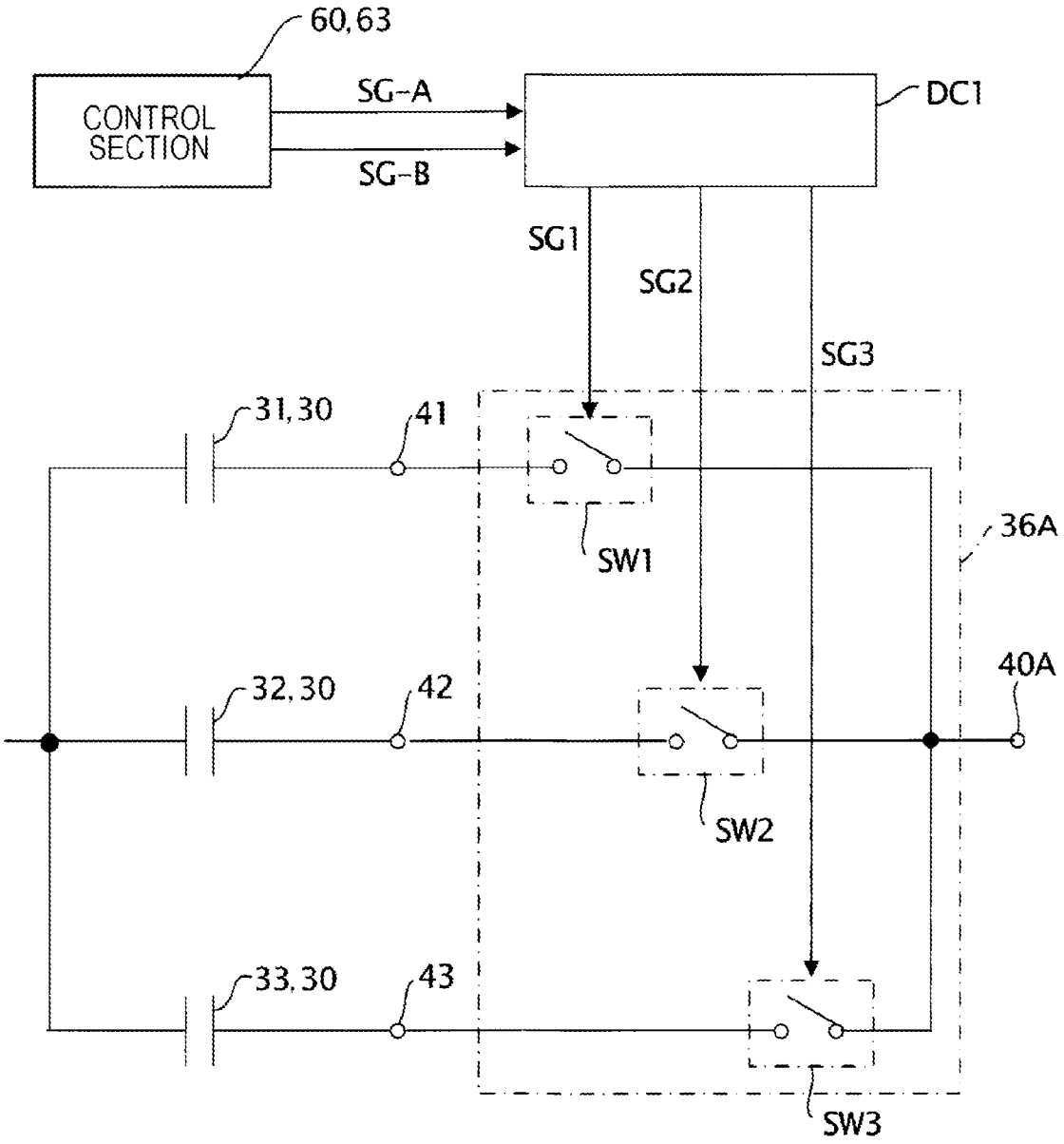
FIG. 7 is a flowchart showing an operation of a selector circuit.

Next, an operation in the selector circuit 36A will be described with reference to FIG. 7. FIG. 7 is a circuit diagram including the selector circuit 36A. The selector circuit 36A includes switches SW1 to SW3. The selector circuit 36A receives selection signals SG1 to SG3, and switches the reception electrodes 31 to 33 used to detect the liquid level L according to the received selection signals SG1 to SG3. The selector circuit 36A may switch the reception electrodes 31 to 33 according to the other states regardless of the selection signals SG1 to SG3.

The switch SW1 is provided between the input terminal 41 and the output terminal 40A. The switch SW2 is provided between the input terminal 42 and the output terminal 40A. The switch SW3 is provided between the input terminal 43 and the output terminal 40A.

A decoder DC1 is electrically coupled to the selector circuit 36A. The control section 60 transmits, to the decoder DC1, command signals SG-A and SG-B that designate any of the reception electrodes 31 to 33 used to measure the liquid level L of the ink 2.

When the command signals SG-A and SG-B designate the reception electrode 31, the decoder DC1 sets the selection signal SG1 to the H level and sets the selection signals SG2 and SG3 to the L level. When the command signals SG-A and SG-B designate the reception electrode 32, the decoder DC1 sets the selection signal SG2 to the H level and sets the selection signals SG1 and SG3 to the L level. When the command signals SG-A and SG-B designate the reception electrode 33, the decoder DC1 sets the selection signal SG3 to the H level and sets the selection signals SG1 and SG2 to the L level.

The switch SW1 is turned on when the selection signal SG1 is at the H level and electrically couples the input terminal 41 to the output terminal 40A. The switch SW1 is turned off when the selection signal SG1 is at the L level and electrically disconnects the input terminal 41 from the output terminal 40A.

The switch SW2 is turned on when the selection signal SG2 is at the H level and electrically couples the input terminal 42 to the output terminal 40A. The switch SW2 is turned off when the selection signal SG2 is at the L level and electrically disconnects the input terminal 42 from the output terminal 40A.

The switch SW3 is turned on when the selection signal SG3 is at the H level and electrically couples the input terminal 43 to the output terminal 40A. The switch SW3 is turned off when the selection signal SG3 is at the L level and electrically disconnects the input terminal 43 from the output terminal 40A.

Figure 8:
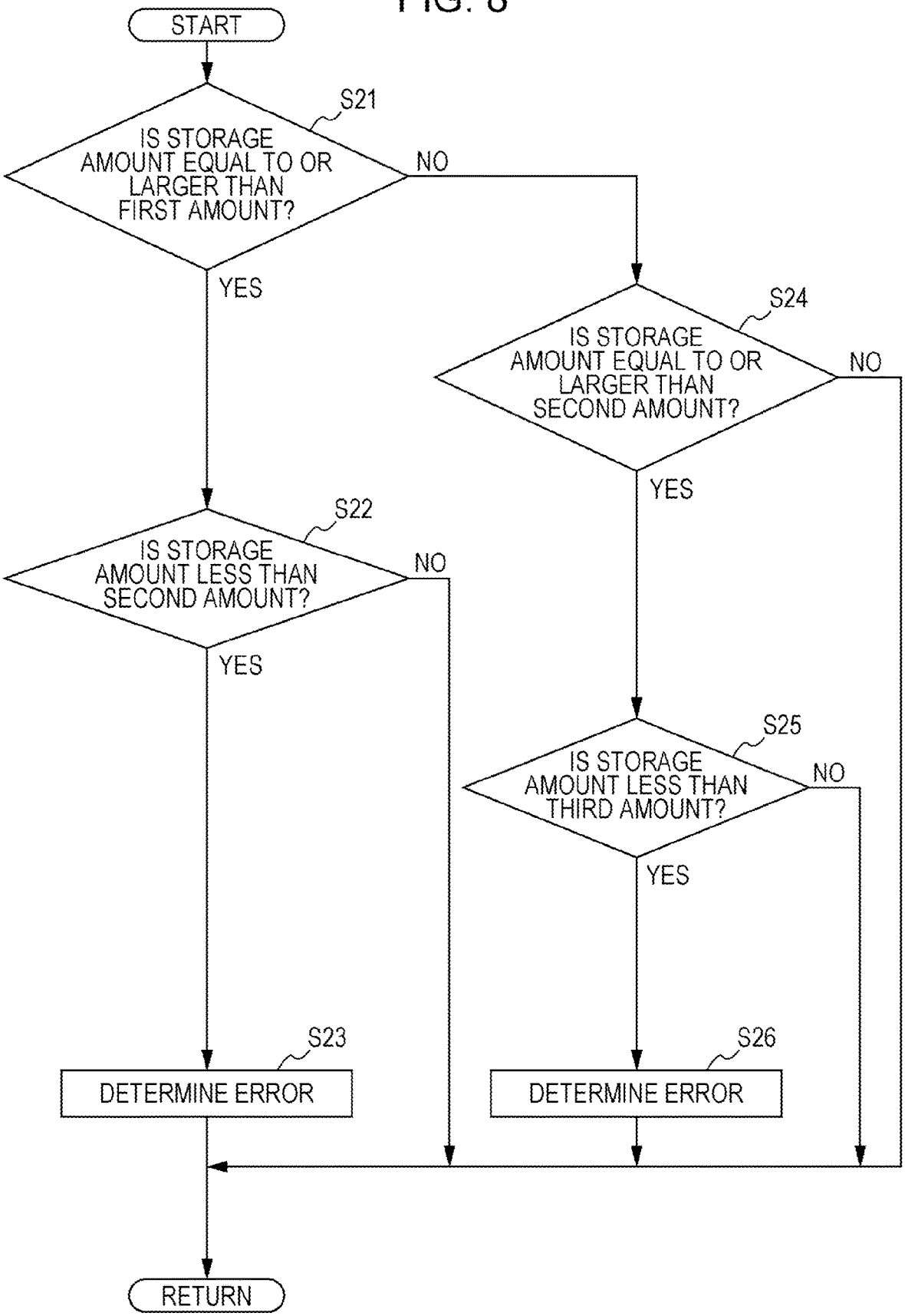
FIG. 8 is a circuit diagram including the selector circuit.

Next, an error determination procedure in the detection circuit 63 will be described with reference to FIG. 8. FIG. 8 is a flowchart showing the error determination procedure in the detection circuit 63. First, in step S21, the detection circuit 63 determines whether or not the storage amount of the ink 2 is equal to or larger than the first amount based on the electric signal output from the output terminal 40A in the state in which the reception electrode 31 is coupled. When the storage amount is equal to or larger than the first amount, the process proceeds to step S22. When the storage amount is not equal to or larger than the first amount, it is determined that the storage amount is less than the first amount and the process proceeds to step S24.

In step S22, the detection circuit 63 determines whether or not the storage amount of the ink 2 is less than the second amount based on the electric signal output from the output terminal 40A in the state in which the reception electrode 32 is coupled. When the storage amount is less than the second amount, the process proceeds to step S23, and it is determined that detection of the storage amount is error. When the storage amount is equal to or larger than the second amount, the detection circuit 63 ends the process here.

In step S24, the detection circuit 63 determines whether or not the storage amount of the ink 2 is equal to or larger than the second amount based on the electric signal output from the output terminal 40A in the state in which the reception electrode 32 is coupled. When the storage amount is equal to or larger than the second amount, the process proceeds to step S25, and, when the storage amount is not equal to or larger than the second amount, the detection circuit 63 ends the process here.

In step S25, the detection circuit 63 determines whether or not the storage amount of the ink 2 is less than the third amount based on the electric signal output from the output terminal 40A in the state in which the reception electrode 33 is coupled. When the storage amount is less than the third amount, the process proceeds to step S26, and it is determined that the detection of the storage amount is error. When the storage amount is equal to or larger than the third amount, the detection circuit 63 ends the process here. The processing procedure shown in FIG. 8 can be arbitrarily changed. For example, the detection circuit 63 may determine whether or not the storage amount is equal to or larger than the second amount after determining whether or not the storage amount is equal to or larger than the third amount.

Since the storage amount detection device 20A according to the first embodiment includes the selector circuit 36A, it is possible to switch whether or not to electrically couple to at least one of the reception electrodes 31 to 33. In the storage amount detection device 20A, it is not necessary to provide a determination circuit for each of the reception electrodes 31 to 33, so that a circuit substrate can be miniaturized. In the storage amount detection device 20A, it is not necessary to perform correction for suppressing a variation in a circuit characteristic that occurs when a plurality of determination circuits are used, so that the circuit substrate can be miniaturized and detection accuracy of the storage amount can be improved.

Since the storage amount detection device 20A includes the filter circuit 37 at the subsequent stage of the selector circuit 36A, noise can be removed from the electric signal output from the output terminal 40A. In the storage amount detection device 20A, the storage amount can be detected based on the electric signal from which noise is removed, so that the detection accuracy of the storage amount can be improved.

In the liquid discharge device 1A, which is a serial-type ink jet printing device, the liquid level L of the ink 2 stored in the storage section 21A is fluctuated when the carriage 6 reciprocates. When the liquid level L fluctuates, the electrostatic capacitance of the capacitors 71 to 73 changes. According to the storage amount detection device 20A, the noise caused by the fluctuation of the liquid level L can be removed by the filter circuit 37, so that the detection accuracy of the storage amount can be improved.

Next, a coupling circuit 80 will be described. As shown in FIG. 2, the storage amount detection device 20A includes the coupling circuit 80. The coupling circuit 80 couples at least one of the reception electrodes 31 to 33, which are not electrically coupled to the output terminal 40A, to a constant voltage terminal 14. The coupling circuit 80 couples the reception electrodes 31 to 33, which are not electrically coupled to the output terminal 40A, of the reception electrodes 31 to 33 to the constant voltage terminal 14. The coupling circuit 80 does not couple the reception electrodes 31 to 33, which are coupled to the output terminal 40A, to the constant voltage terminal 14.

The coupling circuit 80 includes switch circuits 81 to 83. The switch circuit 81 is an example of a first switch circuit. The switch circuit 82 is an example of a second switch circuit. The switch circuit 83 is an example of a third switch circuit. The switch circuit 81 switches whether or not to electrically couple the input terminal 41 to the constant voltage terminal 14. The switch circuit 82 switches whether or not to couple the input terminal 42 to the constant voltage terminal 14. The switch circuit 83 switches whether or not to couple the input terminal 43 to the constant voltage terminal 14. The coupling circuit 80 electrically couples the reception electrodes 31 to 33, which are not used to detect the liquid level L of the ink 2, to the constant voltage terminal 14. The coupling circuit 80 electrically disconnects the reception electrodes 31 to 33, which are used to detect the liquid level L, from the constant voltage terminal 14.

A decoder DC2 is electrically coupled to the coupling circuit 80. The control section 60 transmits, to the decoder DC2, command signals SG-C and SG-D indicating any of the reception electrodes 31 to 33 used to measure the liquid level L of the ink 2. The decoder DC2 that receives the command signals SG-C and SG-D supplies a selection signal SG4 to the switch circuit 81, supplies a selection signal SG5 to the switch circuit 82, and supplies a selection signal SG6 to the switch circuit 83.

When the reception electrode 31 is indicated by the command signals SG-C and SG-D, the decoder DC2 sets the selection signal SG4 to the L level and sets the selection signals SG5 and SG6 to the H level. When the reception electrode 32 is indicated by the command signals SG-C and SG-D, the decoder DC2 sets the selection signal SG5 to the L level and sets the selection signals SG4 and SG6 to the H level. When the reception electrode 33 is indicated by the command signals SG-C and SG-D, the decoder DC2 sets the selection signal SG6 to the L level and sets the selection signals SG4 and SG5 to the H level.

The switch circuit 81 is turned on when the selection signal SG4 is at the H level and electrically couples the reception electrode 31 to the constant voltage terminal 14. The switch circuit 81 is turned off when the selection signal SG4 is at the L level and electrically disconnects the reception electrode 31 from the constant voltage terminal 14.

The switch circuit 82 is turned on when the selection signal SG5 is at the H level and electrically couples the reception electrode 32 to the constant voltage terminal 14. The switch circuit 82 is turned off when the selection signal SG5 is at the L level and electrically disconnects the reception electrode 32 from the constant voltage terminal 14.

The switch circuit 83 is turned on when the selection signal SG6 is at the H level and electrically couples the reception electrode 33 to the constant voltage terminal 14. The switch circuit 83 is turned off when the selection signal SG6 is at the L level and electrically disconnects the reception electrode 33 from the constant voltage terminal 14.

Figure 9:
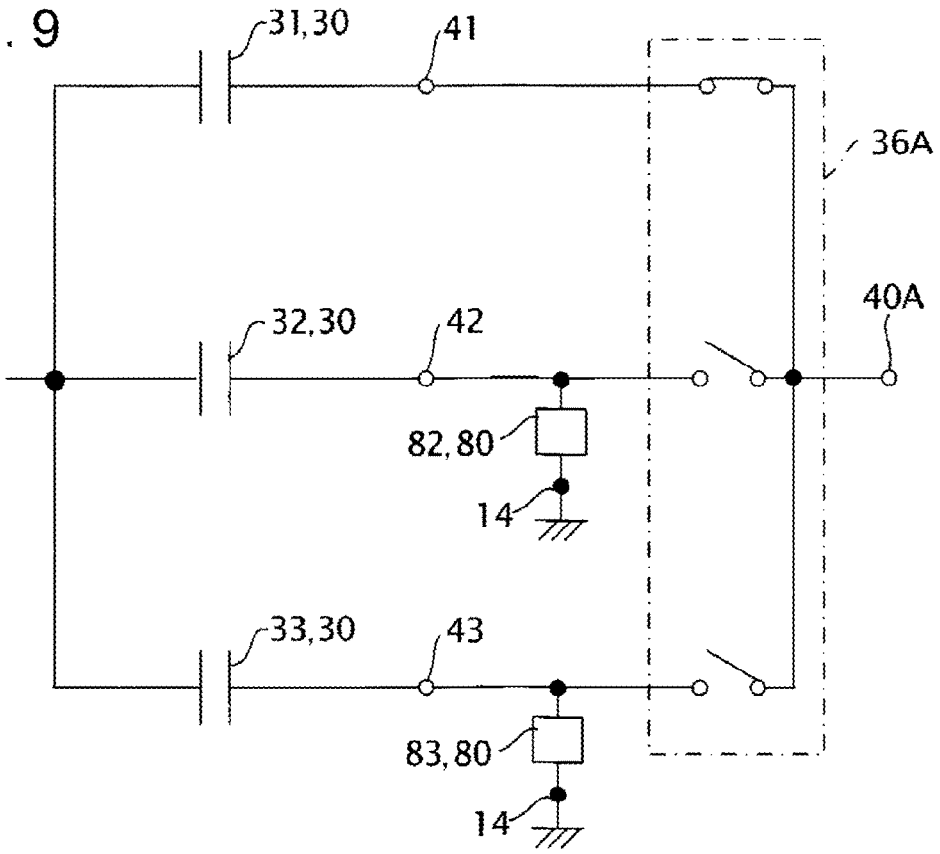
FIG. 9 is a circuit diagram showing a coupling relationship between a reception electrode, which is not coupled to an output terminal, and a constant voltage terminal.
Figure 10:
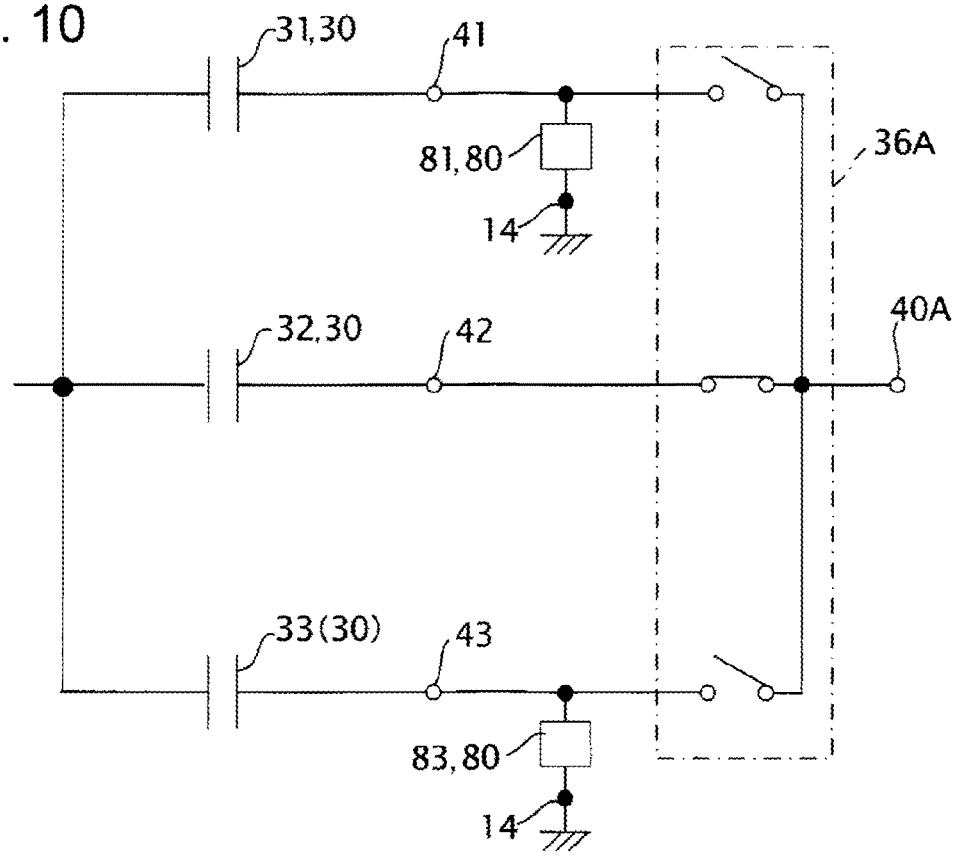
FIG. 10 is a circuit diagram showing the coupling relationship between the reception electrode, which is not coupled to the output terminal, and the constant voltage terminal.
Figure 11:
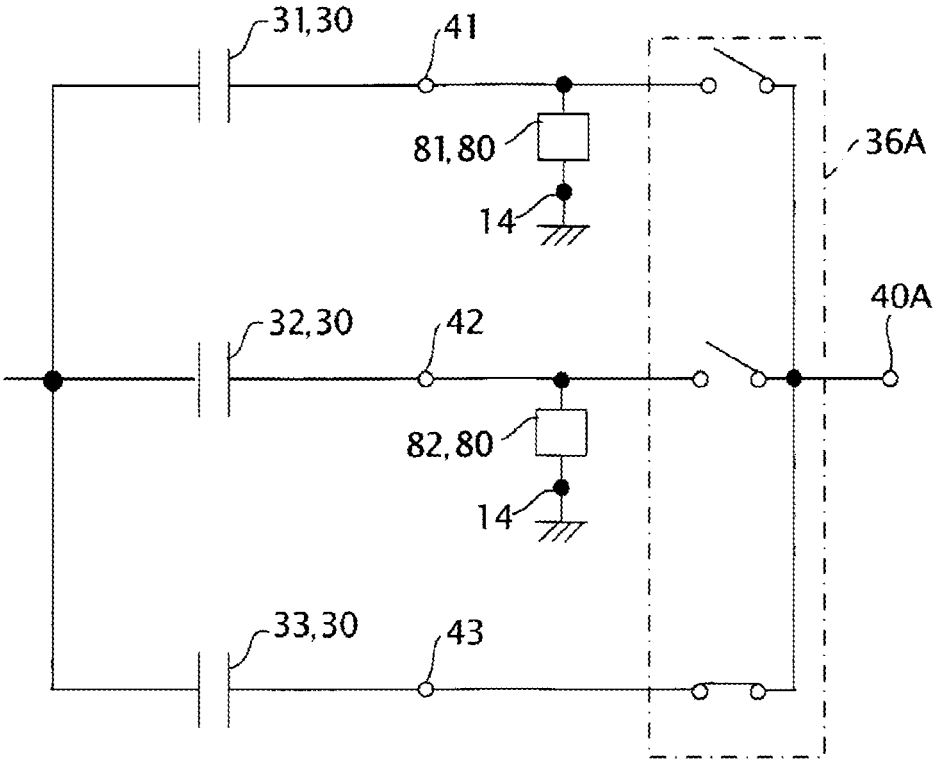
FIG. 11 is a circuit diagram showing the coupling relationship between the reception electrode, which is not coupled to the output terminal, and the constant voltage terminal.

FIGS. 9 to 11 are circuit diagrams showing coupling relationships between the reception electrodes 31 to 33, which are not coupled to the output terminal 40A, and the constant voltage terminal 14. The coupling circuit 80 performs switching such that all the reception electrodes 31 to 33, which are not electrically coupled to the output terminal 40A, among the reception electrodes 31 to 33 are electrically coupled to the constant voltage terminal 14. The coupling circuit 80 switches whether or not to electrically disconnect only one of the reception electrodes 31 to 33 from the constant voltage terminal 14.

As shown in FIG. 9, when the reception electrode 31 is selected to detect the liquid level L of the ink 2, the selector circuit 36A electrically couples the input terminal 41 to the output terminal 40A, and does not couple the input terminal 42 and the input terminal 43 to the output terminal 40A. The switch circuit 82 electrically couples the input terminal 42 to the constant voltage terminal 14, the switch circuit 83 electrically couples the input terminal 43 to the constant voltage terminal 14. The reception electrode 31 is not electrically coupled to the constant voltage terminal 14. The reception electrode 31, which is electrically coupled to the output terminal 40A, is not shielded by the ground potential.

As shown in FIG. 10, when the reception electrode 32 is selected to detect the liquid level L of the ink 2, the selector circuit 36A electrically couples the input terminal 42 to the output terminal 40A, and does not couple the input terminal 41 and the input terminal 43 to the output terminal 40A. The switch circuit 81 electrically couples the input terminal 41 to the constant voltage terminal 14, and the switch circuit 83 electrically couples the input terminal 43 to the constant voltage terminal 14. The reception electrode 32 is not electrically coupled to the constant voltage terminal 14. The reception electrode 32, which is electrically coupled to the output terminal 40A, is not shielded by the ground potential.

As shown in FIG. 11, when the reception electrode 33 is selected to detect the liquid level L of the ink 2, the selector circuit 36A electrically couples the input terminal 43 to the output terminal 40A, and does not couple the input terminal 41 and the input terminal 42 to the output terminal 40A. The switch circuit 81 electrically couples the input terminal 41 to the constant voltage terminal 14, the switch circuit 82 electrically couples the input terminal 42 to the constant voltage terminal 14. The reception electrode 33 is not electrically coupled to the constant voltage terminal 14. The reception electrode 33, which is electrically coupled to the output terminal 40A, is not shielded by the ground potential.

According to the storage amount detection device 20A, the reception electrode 30, which is electrically coupled to the output terminal 40A, is not electrically coupled to the constant voltage terminal 14, and the reception electrode 30, which is not electrically coupled to the output terminal 40A, is electrically coupled to the constant voltage terminal 14. Therefore, the reception electrode 30 that is not used to detect the liquid level L can be prevented from being a state of being electrically floated. In a state in which the reception electrode 30, which is not used, is floated, there is a problem in that residual charges and the like affect detection of the liquid level L by the other reception electrodes 30 when the reception electrode 30 is electrically coupled to the output terminal 40A. In the storage amount detection device 20A, since the reception electrode 30 in the unused state is electrically coupled to the constant voltage terminal 14, the influence of the residual charge and the like can be avoided. As a result, the storage amount detection device 20A can improve detection accuracy of the liquid level L.

Figure 12:
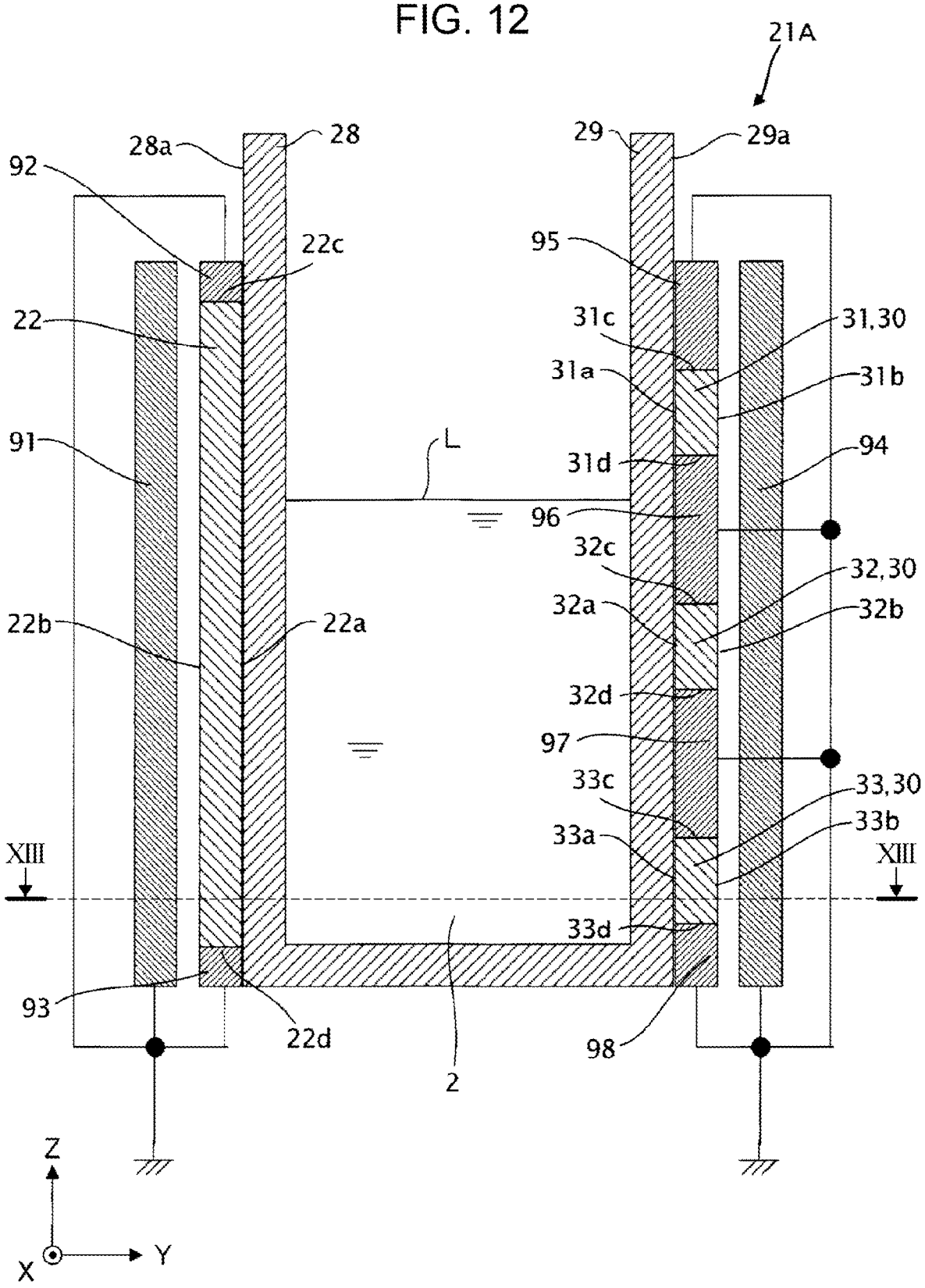
FIG. 12 is a cross-sectional diagram showing the storage section provided with a shield electrode.
Figure 13:
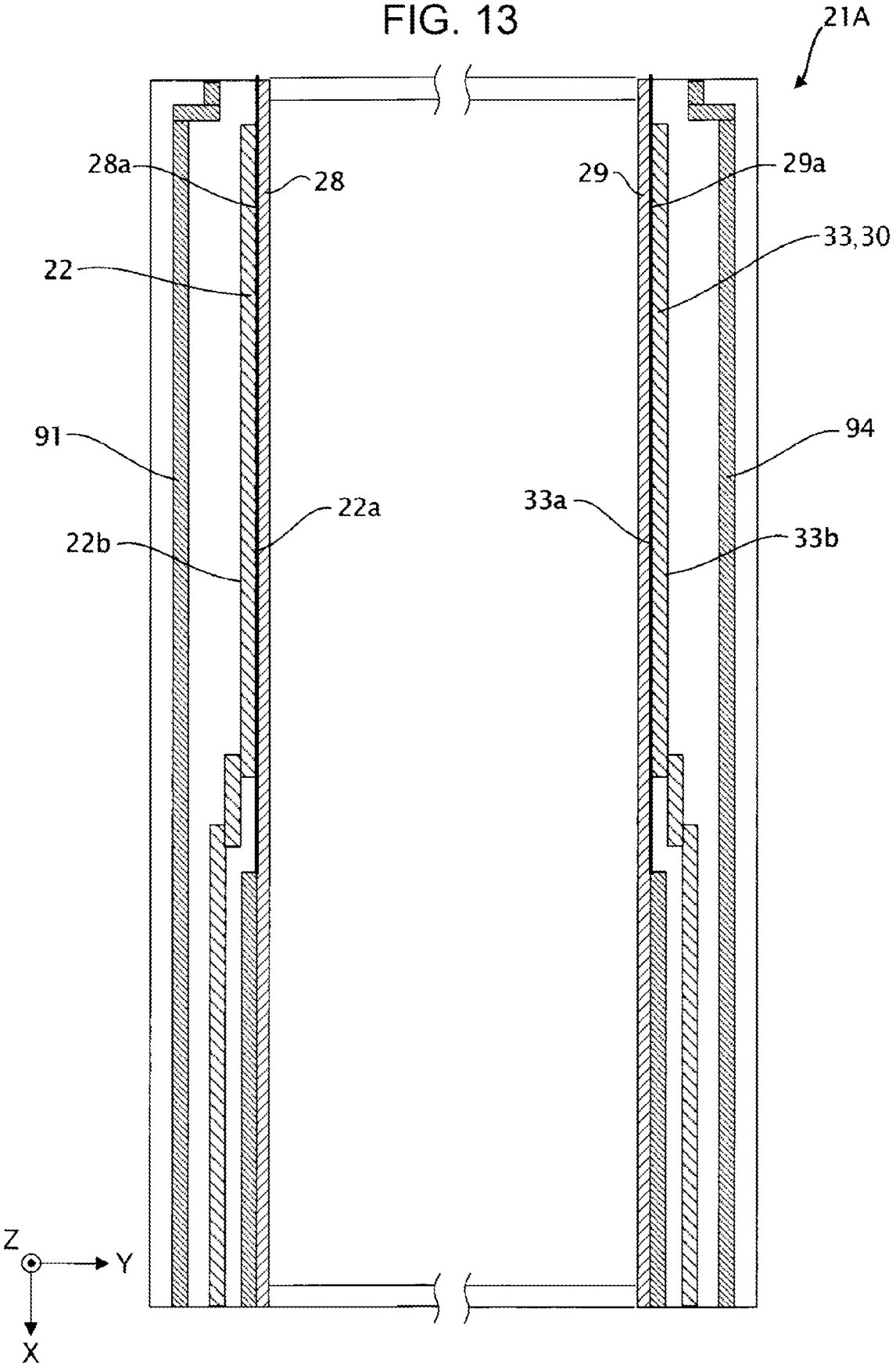
FIG. 13 is a cross-sectional diagram taken along a line XIII-XIII in FIG. 12.
Figure 14:
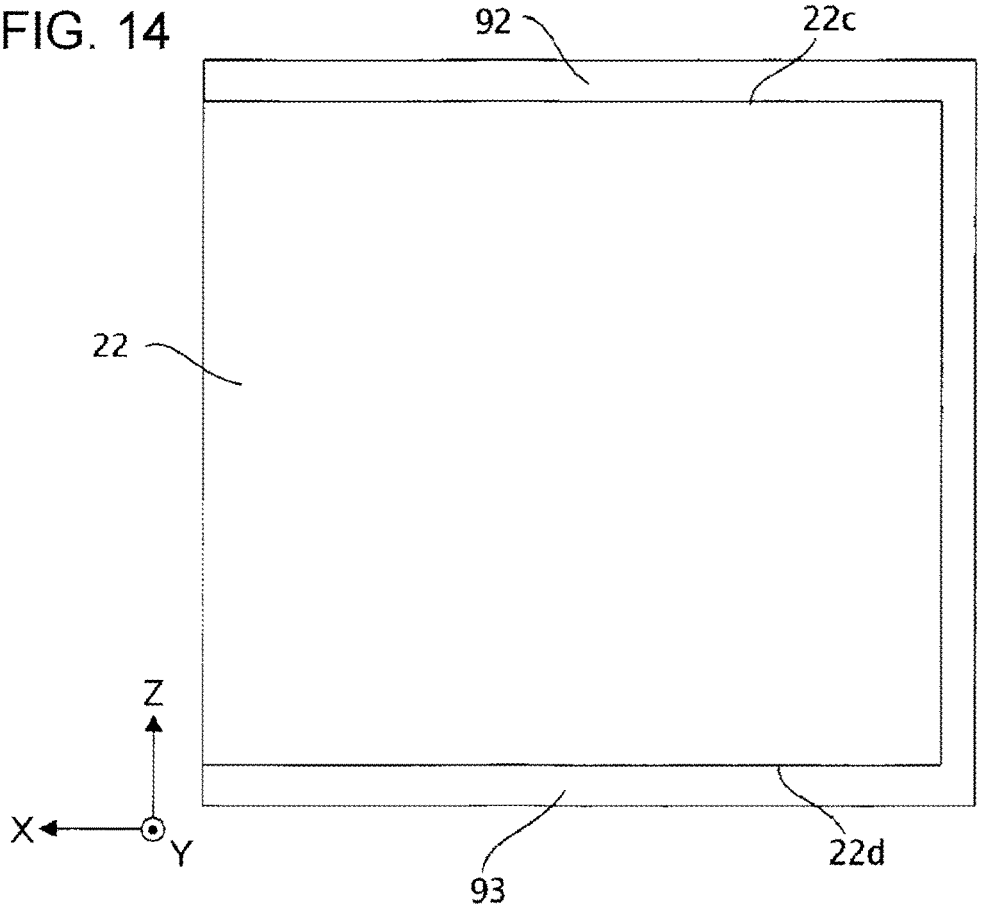
FIG. 14 is a diagram showing a transmission electrode and the shield electrode.
Figure 15:
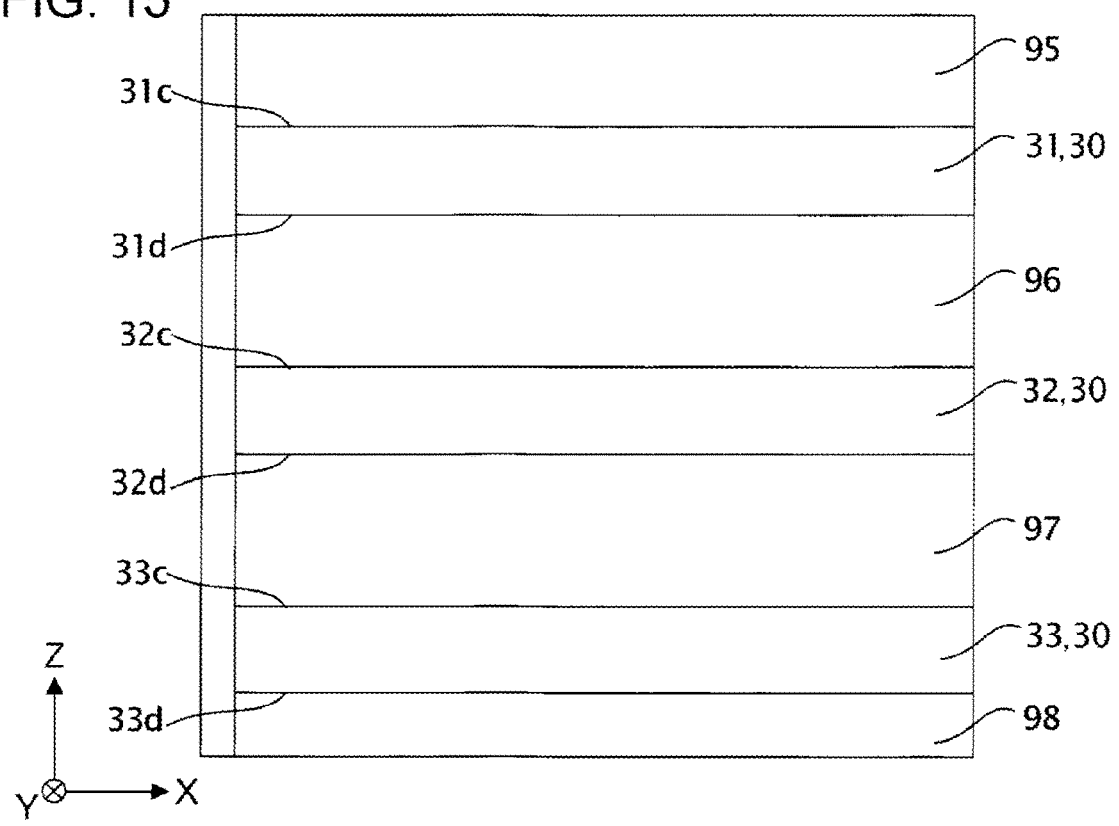
FIG. 15 is a diagram showing the reception electrode and the shield electrode.

Next, shield electrodes 91 to 98 that cover the transmission electrode 22 and the reception electrode 30 will be described with reference to FIGS. 12 to 15. FIG. 12 is a cross-sectional diagram of the storage section 21A, that is, a diagram showing the shield electrodes 91 to 98 that cover the transmission electrode 22 and the reception electrode 30. FIG. 13 is a cross-sectional diagram taken along the line XIII-XIII in FIG. 12. FIG. 14 is a diagram showing the transmission electrode 22 and the shield electrodes 92 and 93. FIG. 15 is a diagram showing the reception electrode 30 and the shield electrodes 95 to 98.

As shown in FIG. 12, the transmission electrode 22 is shielded by the shield electrodes 91 to 93. The shield electrodes 91 to 93 are coupled to the ground potential. The reception electrode 30 is shielded by the shield electrodes 94 to 98. The shield electrodes 94 to 98 are coupled to the ground potential. As the constituent material of the shield electrodes 91 to 98, the same constituent material as the constituent materials of the transmission electrode 22 and the reception electrodes 31 to 33 can be used.

The transmission electrode 22 includes a first surface 22*a* and a second surface 22*b* that are separated from each other in the Y-axis direction. The first surface 22*a* is a surface on a side of the storage section 21A, and the second surface 22*b* is a surface on a side opposite to the storage section 21A. The transmission electrode 22 includes a third surface 22*c* and a fourth surface 22*d* that are separated from each other in the Z-axis direction. The third surface 22*c* is an upper surface, and the fourth surface 22*d* is a lower surface.

The shield electrode 91 is disposed to cover the second surface 22*b* of the transmission electrode 22. The shield electrode 91 and the transmission electrode 22 are separated from each other in the Y-axis direction. A gap is formed between the shield electrode 91 and the transmission electrode 22. An insulator may be disposed between the shield electrode 91 and the transmission electrode 22. The shield electrode 91 has a larger area than the transmission electrode 22. The shield electrode 91 is disposed to cover an entire surface of the second surface 22*b* of the transmission electrode 22. The shield electrode 91 may cover a part of the second surface 22*b* of the transmission electrode 22.

The shield electrode 92 is disposed to cover the third surface 22*c* of the transmission electrode 22. The shield electrode 92 is disposed on an upper side of the third surface 22*c*. An insulator is disposed between the shield electrode 92 and the transmission electrode 22. A gap may be formed between the shield electrode 92 and the transmission electrode 22. The shield electrode 91 may be formed to cover an entire surface of the third surface 22*c*, or may be formed to cover a part of the third surface 22*c*.

The shield electrode 93 is disposed to cover the fourth surface 22*d* of the transmission electrode 22. The shield electrode 93 is disposed on a lower side of the fourth surface 22*d*. An insulator is disposed between the shield electrode 93 and the transmission electrode 22. A gap may be formed between the shield electrode 93 and the transmission electrode 22. The shield electrode 93 may be formed to cover an entire surface of the fourth surface 22*d*, or may be formed to cover a part of the fourth surface 22*d*. The shield electrodes may be disposed on both sides of the transmission electrode 22 in the X-axis direction.

The reception electrode 31 includes a first surface 31*a* and a second surface 31*b* that are separated from each other in the Y-axis direction. The first surface 31*a* is a surface on a side of the storage section 21A, and the second surface 31*b* is a surface on a side opposite to the storage section 21A. The reception electrode 31 includes a third surface 31*c* and a fourth surface 31*d* that are separated from each other in the Z-axis direction. The first surface 31*a* is a surface on a side of the storage section 21A, and the second surface 31*b* is a surface on a side opposite to the storage section 21A. The third surface 31*c* is an upper surface, and the fourth surface 31*d* is a lower surface.

Similarly, the reception electrode 32 includes a first surface 32*a*, a second surface 32*b*, a third surface 32*c*, and a fourth surface 32*d*. The first surface 32*a* and the second surface 32*b* are separated from each other in the Y-axis direction. The third surface 32*c* and the fourth surface 32*d* are separated from each other in the Z-axis direction. The first surface 32*a* is a surface on a side of the storage section 21A, and the second surface 32*b* is a surface on a side opposite to the storage section 21A. The third surface 32*c* is an upper surface, and the fourth surface 32*d* is a lower surface.

The reception electrode 33 includes a first surface 33*a*, a second surface 33*b*, a third surface 33*c*, and a fourth surface 33*d*. The first surface 33*a* and the second surface 33*b* are separated from each other in the Y-axis direction. The third surface 33*c* and the fourth surface 33*d* are separated from each other in the Z-axis direction. The first surface 33*a* is a surface on a side of the storage section 21A, and the second surface 33*b* is a surface on a side opposite to the storage section 21A. The third surface 33*c* is an upper surface, and the fourth surface 33*d* is a lower surface.

The shield electrode 94 is disposed to cover the second surface 31*b* of the reception electrode 31, the second surface 32*b* of the reception electrode 32, and the second surface 33*b* of the reception electrode 33. The shield electrode 94 and the reception electrode 30 are separated from each other in the Y-axis direction. A gap is formed between the shield electrode 91 and the reception electrode 30. An insulator may be disposed between the shield electrode 94 and the reception electrode 30. The shield electrode 94 is disposed to cover an entire surface including the second surface 31*b* of the reception electrode 31, the second surface 32*b* of the reception electrode 32, and the second surface 33*b* of the reception electrode 33. The shield electrode 94 may cover a part of the second surface 31*b* of the reception electrode 31, the second surface 32*b* of the reception electrode 32, and the second surface 33*b* of the reception electrode 33.

The shield electrode 95 is disposed to cover the third surface 31*c* of the reception electrode 31. The shield electrode 95 is disposed on an upper side of the third surface 31*c*. An insulator is disposed between the shield electrode 95 and the reception electrode 31. A gap may be formed between the shield electrode 95 and the reception electrode 31. The shield electrode 95 may be formed to cover an entire surface of the third surface 31*c*, or may be formed to cover a part of the third surface 31*c*.

The shield electrode 96 is disposed between the reception electrode 31 and the reception electrode 32 in the Z-axis direction. The shield electrode 96 is disposed to cover the fourth surface 31*d* of the reception electrode 31 and the third surface 32*c* of the reception electrode 32. An insulator is disposed between the shield electrode 96 and the reception electrode 31. An insulator is disposed between the shield electrode 96 and the reception electrode 32. A gap may be formed between the shield electrode 96 and the reception electrode 31. A gap may be formed between the shield electrode 96 and the reception electrode 32. The shield electrode 96 may be formed to cover an entire surface including the fourth surface 31*d* of the reception electrode 31 and the third surface 32*c* of the reception electrode 32, and may be formed to cover a part of the fourth surface 31*d* and the third surface 32*c*.

The shield electrode 97 is disposed between the reception electrode 32 and the reception electrode 33 in the Z-axis direction. The shield electrode 97 is disposed to cover the fourth surface 32*d* of the reception electrode 32 and the third surface 33*c* of the reception electrode 33. An insulator is disposed between the shield electrode 97 and the reception electrode 32. An insulator is disposed between the shield electrode 97 and the reception electrode 33. A gap may be formed between the shield electrode 97 and the reception electrode 32. A gap may be formed between the shield electrode 97 and the reception electrode 33. The shield electrode 97 may be formed to cover an entire surface including the fourth surface 32*d* of the reception electrode 32 and the third surface 33*c* of the reception electrode 33, and may be formed to cover a part of the fourth surface 32*d* and the third surface 33*c*.

The shield electrode 98 is disposed to cover the fourth surface 33*d* of the reception electrode 33. The shield electrode 98 is disposed on a lower side of the fourth surface 33*d*. An insulator is disposed between the shield electrode 98 and the reception electrode 33. A gap may be formed between the shield electrode 98 and the reception electrode 33. The shield electrode 98 may be formed to cover an entire surface of the fourth surface 33*d*, or may be formed to cover a part of the fourth surface 33*d*.

According to the storage amount detection device 20A, the transmission electrode 22 and the reception electrode 30 are covered by the shield electrodes 91 to 98, so that the influence due to noise is reduced.

Figure 16:
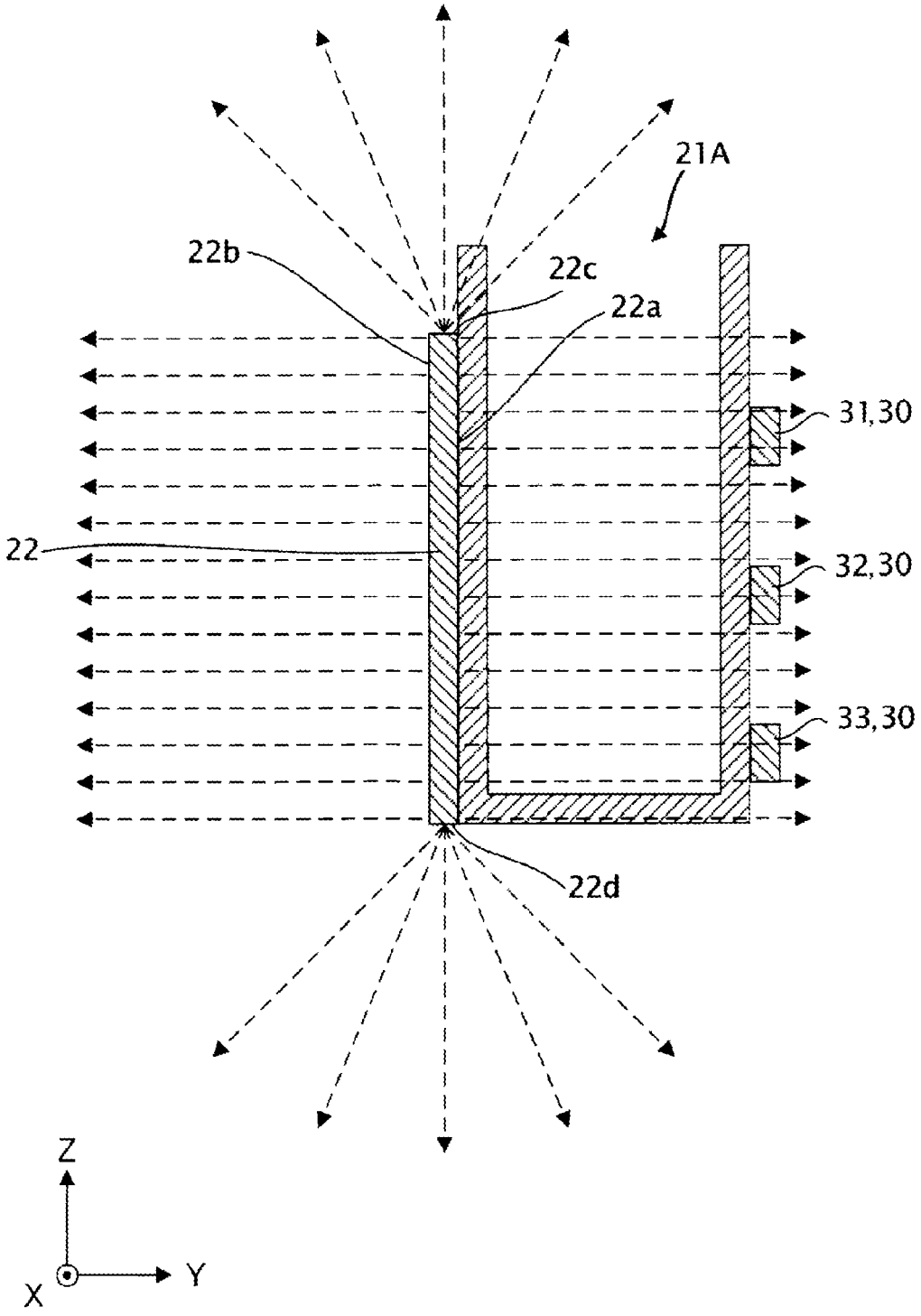
FIG. 16 is a cross-sectional diagram of the storage section, that is, a diagram showing lines of electric force emitted from the transmission electrode.
Figure 17:
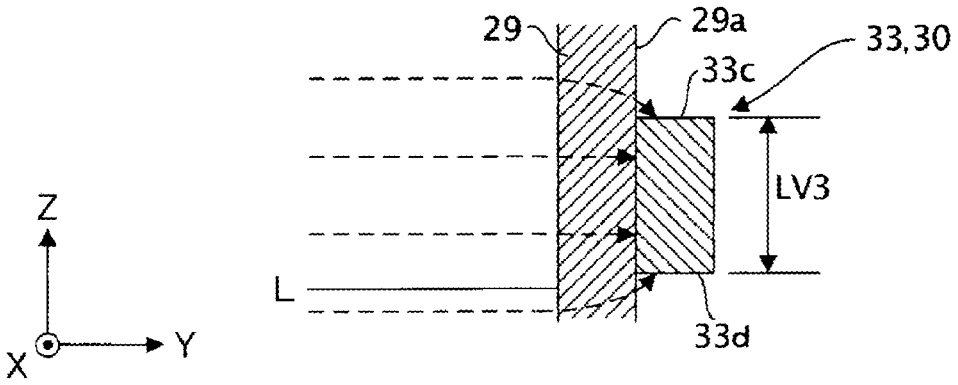
FIG. 17 is a diagram showing the lines of electric force received by the reception electrode.
Figure 18:
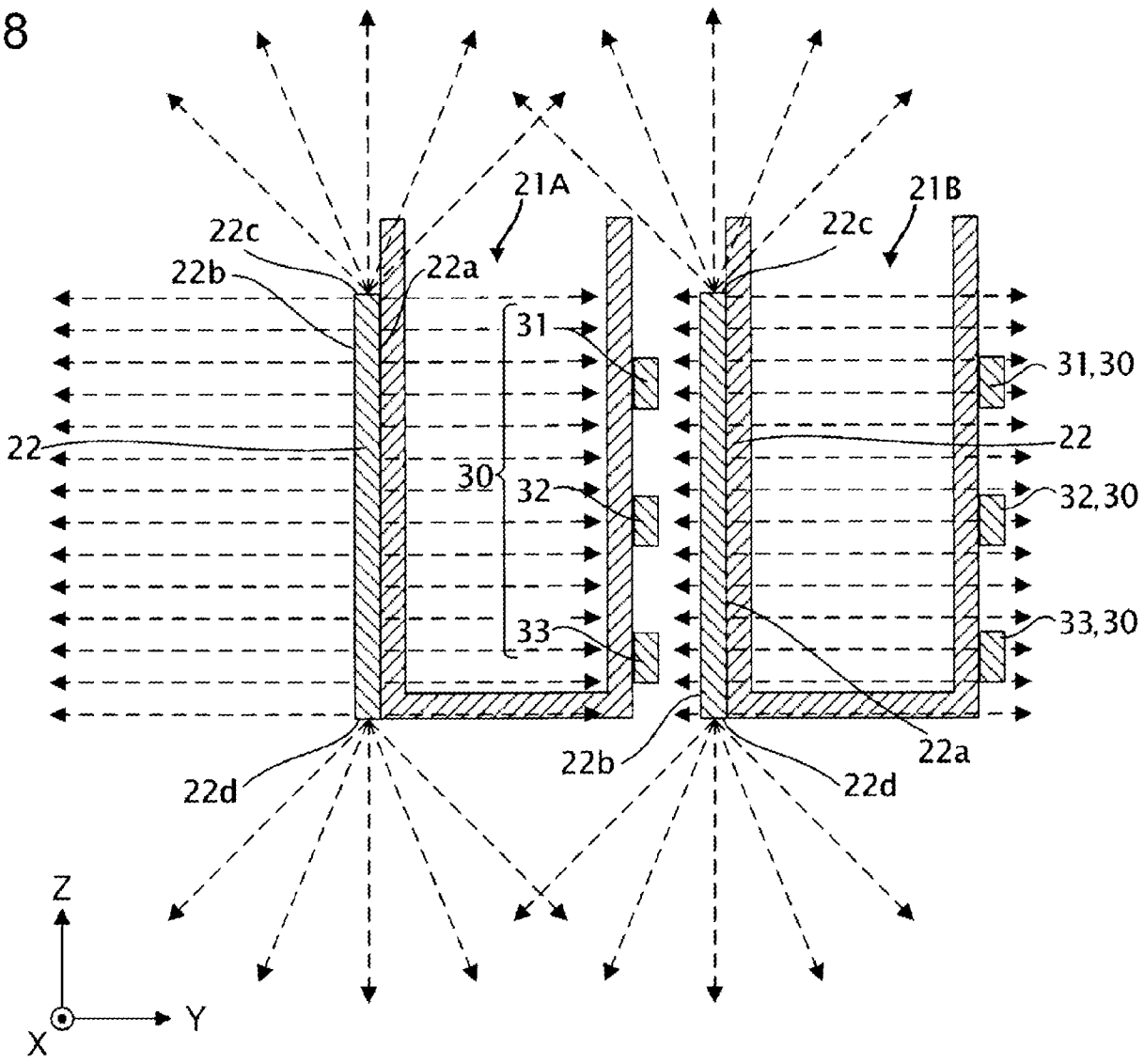
FIG. 18 is a cross-sectional diagram of a plurality of storage sections, that is, a diagram showing lines of electric force emitted from a plurality of transmission electrodes.

Next, the influence due to noise will be described with reference to FIGS. 16 to 18. FIG. 16 is a cross-sectional diagram of the storage section 21A, that is, a diagram showing lines of electric force emitted from the transmission electrode 22. FIG. 17 is a diagram showing the enlarged reception electrode 30, that is, a diagram showing the lines of electric force received by the reception electrode 30. FIG. 18 is a cross-sectional diagram of the plurality of storage sections 21A and 21B, that is, a diagram showing lines of electric force emitted from a plurality of transmission electrodes 22. In each drawing, the lines of electric force are indicated by broken lines with arrows.

As shown in FIG. 16, the lines of electric force are emitted from the first surface 22*a*, the second surface 22*b*, the third surface 22*c*, and the fourth surface 22*d* of the transmission electrode 22. The lines of electric force, which are emitted from the first surface 22*a* and extend in the Y-axis direction, may be received by the reception electrode 31, the reception electrode 32, and the reception electrode 33. There is a case where lines of electric force radiated from the third surface 22*c* and the fourth surface 22*d* interfere with surrounding conductors, so that noise is generated. As a surrounding conductor that has a problem of the interference, there is a housing grounding.

In FIG. 17, the reception electrode 33 is shown, and the liquid level L of the ink 2 exists at a position which is a lower side than the fourth surface 33*d* of the reception electrode 33 and is close to the fourth surface 33*d*. The liquid level L exists outside a range of the liquid level range LV3. When the lines of electric force radiated from the third surface 22*c* and the fourth surface 22*d* of the transmission electrode 22 interfere with the surrounding conductors, there is a problem in that a part of the lines of electric force that passes through the ink 2 is curved toward a side of the reception electrode 33 in the vicinity of the reception electrode 33 and is received by the fourth surface 33*d*. Therefore, there is a case where a value of an output voltage $L_{out}$ is not lower than VL [V] regardless that the liquid level L is on a lower side than the liquid level range LV. Therefore, there is a problem in that erroneous detection, in which the liquid level L exists within the liquid level range LV3, is performed. There is a problem in that the influence due to noise occurs. There is a problem in that the influence of noise also occurs in the reception electrode 31 and the reception electrode 32, similarly to the reception electrode 33.

As described above, in the storage amount detection device 20A, the second surface 22*b*, the third surface 22*c*, and the fourth surface 22*d* of the transmission electrode 22 are covered by the shield electrodes 91 to 93. The shield electrodes 91 to 93 suppress the lines of electric force emitted from the second surface 22*b*, the third surface 22*c*, and the fourth surface 22*d*, so that the problem of interfering with the surrounding conductors is reduced.

In the storage amount detection device 20A, the second surface 33*b*, the third surface 33*c*, and the fourth surface 33*d* of the reception electrode 33 are covered by the shield electrodes 94, 97, and 98. Therefore, the lines of electric force surrounding the reception electrode 33 are suppressed from being received by the second surface 33*b*, the third surface 33*c*, and the fourth surface 33*d*. As described above, when the liquid level L exists on a lower side than the fourth surface 33*d*, the lines of electric force that pass through the ink 2 are suppressed from being received by the fourth surface 33*d*. Therefore, a decrease in detection accuracy of a value of the output voltage $V_{out}$ is suppressed. As a result, detection accuracy of the height position of the liquid level L is improved. Since the reception electrode 31 and the reception electrode 32 are similarly covered by the shield electrodes 94 to 97, the decrease in the detection accuracy of the value of the output voltage $V_{out}$ is suppressed, so that the detection accuracy of the height position of the liquid level L is improved. Therefore, in the storage amount detection device 20A, the storage amount of the ink 2 can be accurately detected. Further, in the storage amount detection device 20A, the lines of electric force emitted from other conductors are prevented from being received by the reception electrodes 31 to 33.

Next, with reference to FIG. 18, influence of noise when a plurality of storage sections 21A and 21B are provided will be described. As shown in FIG. 18, the storage section 21A and the storage section 21B are disposed to be separated from each other in the Y-axis direction. The transmission electrode 22 of the storage section 21B is disposed next to the reception electrodes 31 to 33 of the storage section 21A.

As shown in FIG. 18, the lines of electric force are emitted from the first surface 22*a*, the second surface 22*b*, the third surface 22*c*, and the fourth surface 22*d* of the transmission electrode 22 of the storage section 21B. The lines of electric force, which are emitted from the first surface 22*a* and extend in the Y-axis direction, may be received by the reception electrode 31, the reception electrode 32, and the reception electrode 33. There is a problem in that a part of the lines of electric force emitted from the second surface 22*b* of the storage section 21B is received by the reception electrode 30 of the storage section 21A.

In the storage amount detection device 20A, the second surface 33*b*, the third surface 33*c*, and the fourth surface 33*d* of the reception electrode 33 are covered by the shield electrodes 94, 97, and 98. Therefore, the lines of electric force emitted from the transmission electrode 22 of the adjacent storage section 21B are suppressed from being received by the reception electrode 33 of the storage section 21A. Therefore, a decrease in detection accuracy of a value of the output voltage $V_{out}$ is suppressed. As a result, detection accuracy of the height position of the liquid level L is improved. Since the reception electrode 31 and the reception electrode 32 are similarly covered by the shield electrodes, the decrease in the detection accuracy of the value of the output voltage $V_{out}$ is suppressed, so that the detection accuracy of the height position of the liquid level L is improved. Therefore, in the storage amount detection device 20A, the storage amount of the ink 2 can be accurately detected.

Next, a switch circuit 13 and a noise detection mode will be described. As shown in FIG. 2, the storage amount detection device 20A includes the switch circuit 13 coupled between the AC power supply 12 and the transmission electrode 22. The storage amount detection device 20A can switch between the noise detection mode for detecting noise and a liquid level detection mode for detecting the storage amount of the ink 2. The storage amount detection device 20A switches the reception electrodes 31 to 33, and executes the noise detection mode and the liquid level detection mode for each of the reception electrodes 31 to 33. The storage amount detection device 20A can alternately execute a measurement mode and the noise detection mode.

The control section 60 outputs a designation signal that designates an operation mode of the storage amount detection device 20A. When receiving the designation signal, the switch circuit 13 performs switch OFF, cuts the coupling between the AC power supply 12 and the transmission electrode 22, and executes the noise detection mode. After executing the noise detection mode, the switch circuit 13 performs switch ON, couples the AC power supply 12 to the transmission electrode 22 for conduction, and executes the measurement mode.

Figure 19:
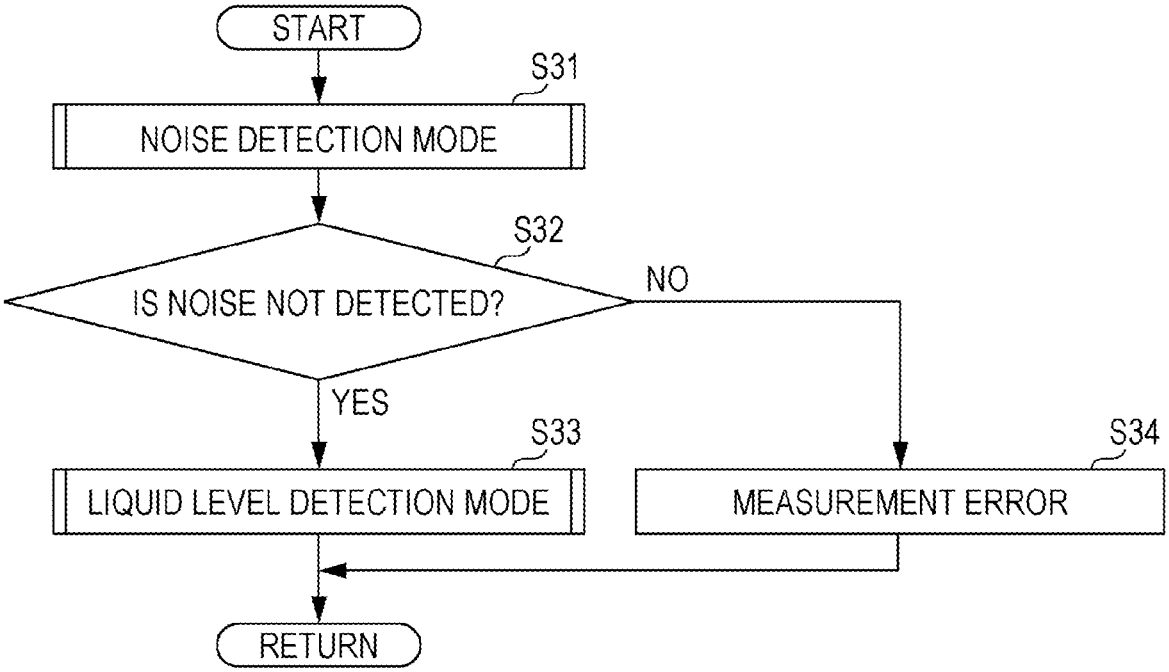
FIG. 19 is a flowchart showing a processing procedure of the storage amount detection device.
Figure 20:
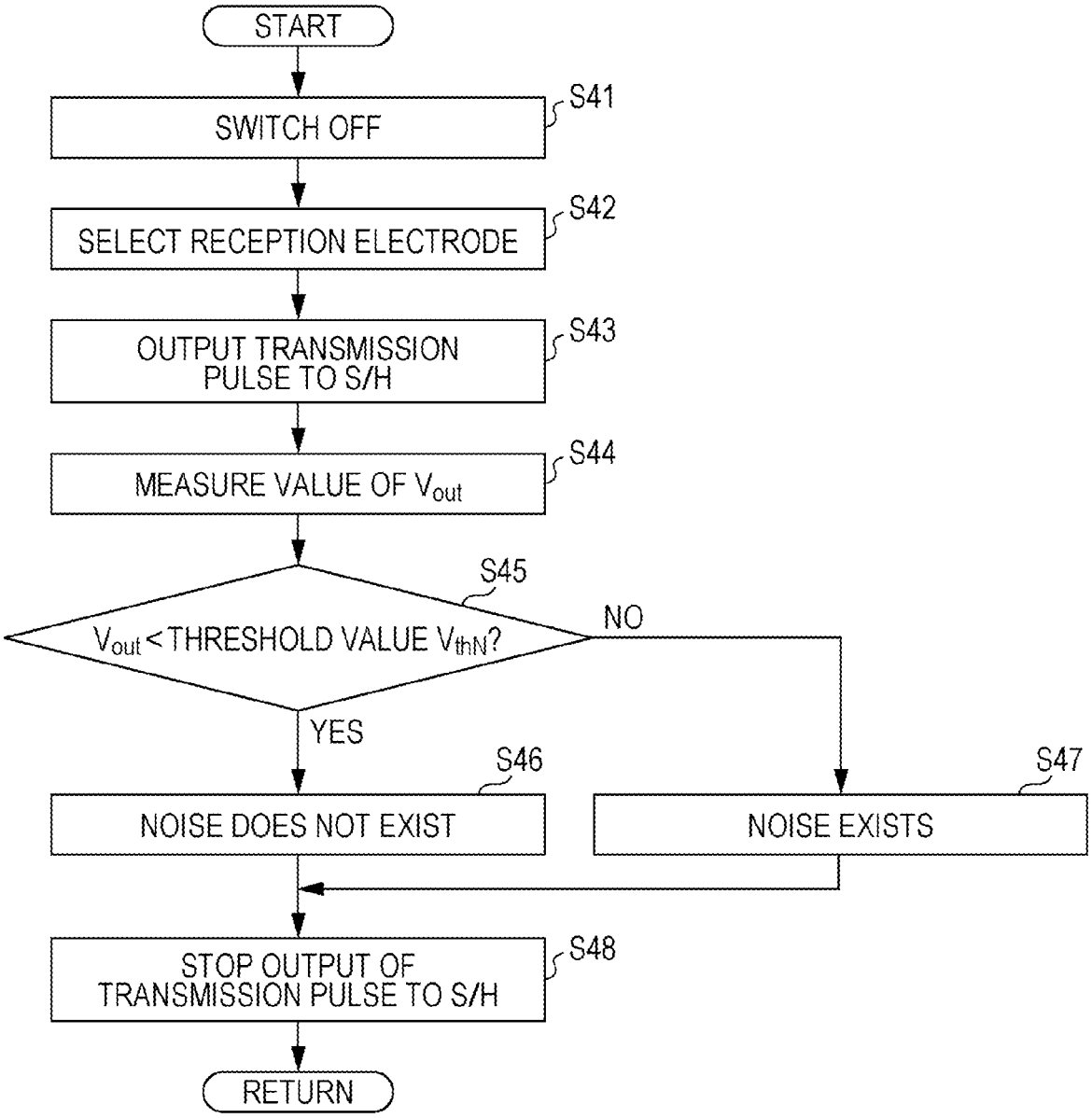
FIG. 20 is a flowchart showing a procedure in a noise detection mode.
Figure 21:
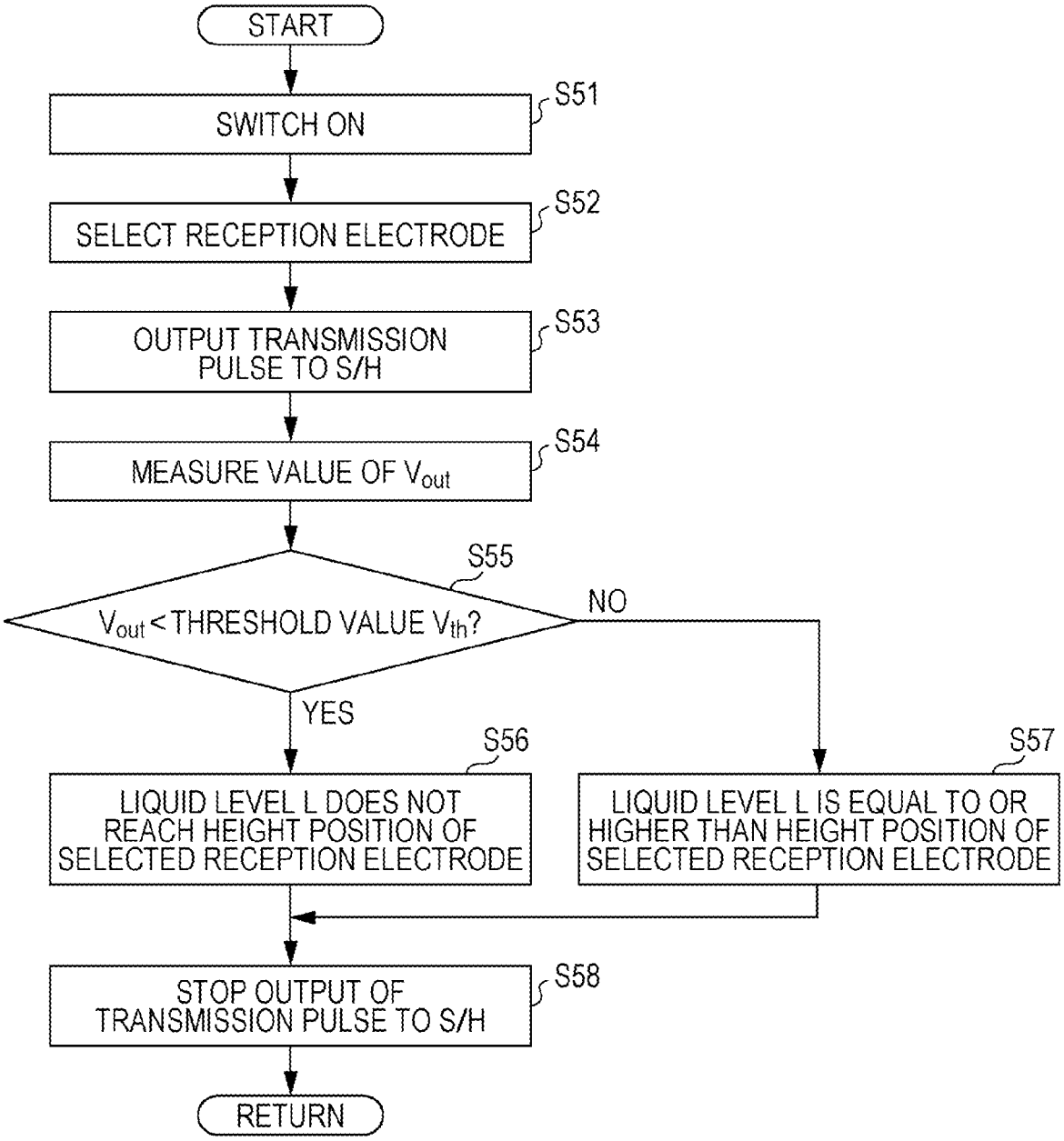
FIG. 21 is a flowchart showing a procedure in a liquid level measurement mode.

Next, a processing procedure in the storage amount detection device 20A will be described with reference to FIGS. 19 to 21. FIG. 19 is a flowchart showing the processing procedure of the storage amount detection device 20A. FIG. 20 is a flowchart showing a procedure in the noise detection mode. FIG. 21 is a flowchart showing a procedure in the liquid level measurement mode.

As shown in FIG. 19, the storage amount detection device 20A executes the noise detection mode as step S31. In the noise detection mode, the processes in steps S41 to S48 shown in FIG. 20 are executed. In step S41, the switch circuit 13 performs switch OFF and cuts the coupling between the AC power supply 12 and the transmission electrode 22.

In step S42, the reception electrode is selected. The selector circuit 36A selects the reception electrodes 31 to 33 by coupling at least one of the input terminals 41 to 43 to the output terminal 40A. In step S43, the AC power supply 12 outputs a transmission pulse to the S/H 53.

In step S44, the control section 60 measures the output voltage $V_{out}$ based on outputs from the selected reception electrodes 31 to 33. The electric signals output from the reception electrodes 31 to 33 are input to the control section 60 after passing through the buffer circuit 51, the BPF 52, the S/H 53, the LPF 54, and the amplifier circuit 55. The detection circuit 63 of the control section 60 calculates the output voltage $V_{out}$ based on the output from the amplifier circuit 55.

In step S45, the detection circuit 63 determines whether or not the output voltage $V_{out}$ is less than a threshold value $V_{thN}$. The threshold value $V_{thN}$ is a determination threshold value for determining whether or not noise exists at the output voltage $V_{out}$. When the output voltage $V_{out}$ is less than the threshold value $V_{thN}$, the process proceeds to step S46, the control section 60 records that noise does not exist. When the output voltage $V_{out}$ is equal to or larger than the threshold value $V_{thN}$, the process proceeds to step S47, and the control section 60 records that noise exists. In the subsequent step S48, the AC power supply 12 stops to output the transmission pulse to the S/H 53.

After executing step S48, the noise detection mode ends, and step S32 shown in FIG. 19 is executed. In step S32, it is determined whether or not noise is detected in the noise detection mode. When being recorded that noise does not exist in step S46, the process proceeds to step S33, the liquid level detection mode is executed, and, when being recorded that noise exists in step S47, the process proceeds to step S34, a measurement error is recorded, and the liquid level detection mode is not executed. In a case of the measurement error, the storage amount detection device 20A can provide a notification to the user by performing display using the notification section 11.

In the ink liquid level detection mode of step S33, processes from step S51 to step S58, which are shown in FIG. 21, are executed. In step S51, the switch circuit 13 performs switch ON, and couples the AC power supply 12 to the transmission electrode 22 for conduction.

In step S52, the reception electrodes 31 to 33 are selected. The selector circuit 36A selects the reception electrodes 31 to 33 by coupling at least one of the input terminals 41 to 43 to the output terminal 40A. In step S53, the AC power supply 12 outputs a transmission pulse to the S/H 53.

In step S54, the control section 60 measures the output voltage $V_{out}$ based on the outputs from the selected reception electrodes 31 to 33. The electric signals output from the reception electrodes 31 to 33 are input to the control section 60 after passing through the buffer circuit 51, the BPF 52, the S/H 53, the LPF 54, and the amplifier circuit 55. The detection circuit 63 of the control section 60 measures the output voltage $V_{out}$.

In step S55, the detection circuit 63 determines whether or not the output voltage $V_{out}$ is less than the threshold value $V_{th}$. The threshold value $V_{th}$ is a determination threshold value for determining whether or not the liquid level L of the ink 2 exists at a relevant height position. When the output voltage $V_{out}$ is less than the threshold value $V_{th}$, the process proceeds to step S56, and the control section 60 records that the liquid level L does not reach the height position of the selected reception electrode. When the output voltage $V_{out}$ is equal to or larger than the threshold value $V_{th}$, the process proceeds to step S57, and the control section 60 records that the liquid level L is equal to or higher than the height position of the selected reception electrode. In the following step S58, the AC power supply 12 stops the output of the transmission pulse to the S/H 53. After executing step S58, the control section 60 ends the liquid level detection mode.

The storage amount detection device 20A includes the switch circuit 13, cuts the coupling between the AC power supply 12 and the transmission electrode 22, thereby enabling the noise detection mode to be executed. In the storage amount detection device 20A, when a measurement error occurs in the noise detection mode, the liquid level detection mode is not executed, so that erroneous detection due to the influence of noise is prevented. In the storage amount detection device 20A, the erroneous detection due to the influence of noise is prevented, so that a decrease in detection accuracy is avoided.

Since the storage amount detection device 20A includes the selector circuit 36A, it is not necessary to provide the detection circuits for the respective reception electrodes 31 to 33 in order to execute the noise detection mode, so that the circuit substrate can be miniaturized.

Figure 22:
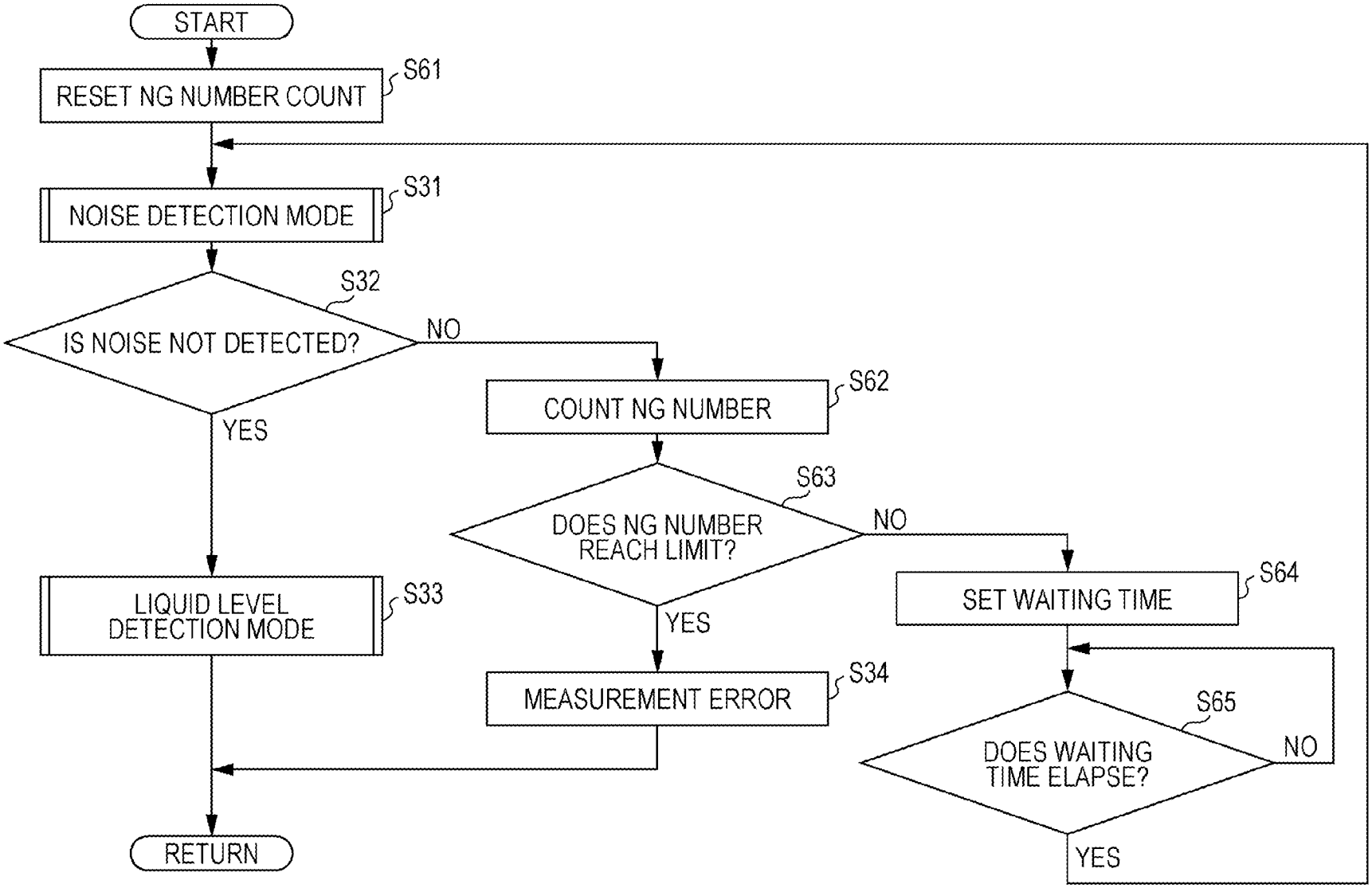
FIG. 22 is a flowchart showing a processing procedure of the storage amount detection device according to a first modification example.

Next, with reference to FIG. 22, a processing procedure of the storage amount detection device 20A according to a first modification example will be described. FIG. 22 is a flowchart showing the processing procedure of the storage amount detection device 20A according to the first modification example. The difference between the storage amount detection device 20A according to the first modification example and the storage amount detection device 20A according to the first embodiment is that the processing procedure shown in FIG. 22 is executed instead of the processing procedure shown in FIG. 19.

First, as step S61, the control section 60 of the storage amount detection device 20A resets an NG number count. The NG count number is the number of times recorded that noise exists in the noise detection mode. The NG count number is counted in step S62, which will be described later. After executing step S61, the process proceeds to step S32, and the storage amount detection device 20A executes the noise detection mode shown in FIG. 20.

After executing the noise detection mode, the process proceeds to step S33, and, when noise detection is not performed, the liquid level detection mode of step S34 is executed. When noise is detected in the noise detection mode, the process proceeds to step S62 and the NG number is counted. The control section 60 adds "1" to the NG number.

Subsequently, in step S63, the control section 60 determines whether or not the NG number reaches the limit. The limit of the NG number can be set arbitrarily. When the NG number reaches the limit, the process proceeds to step S34, a measurement error is recorded, and the liquid level detection mode is not executed.

When the NG number does not reach the limit, the process proceeds to step S64 and the waiting time is set. Next, in step S65, it is determined whether or not the waiting time elapses. When the waiting time does not elapse, the process in step S65 is repeated, and, when the waiting time elapses, the process returns to step S31 and the noise detection mode is executed.

In the storage amount detection device 20A according to the first modification example, when noise is detected, the noise detection mode can be executed again after waiting for the elapse of the waiting time. Therefore, even when noise is detected, the liquid level detection mode can be executed after waiting for noise to be not detected. Therefore, reliability of the device can be improved.

Figure 23:
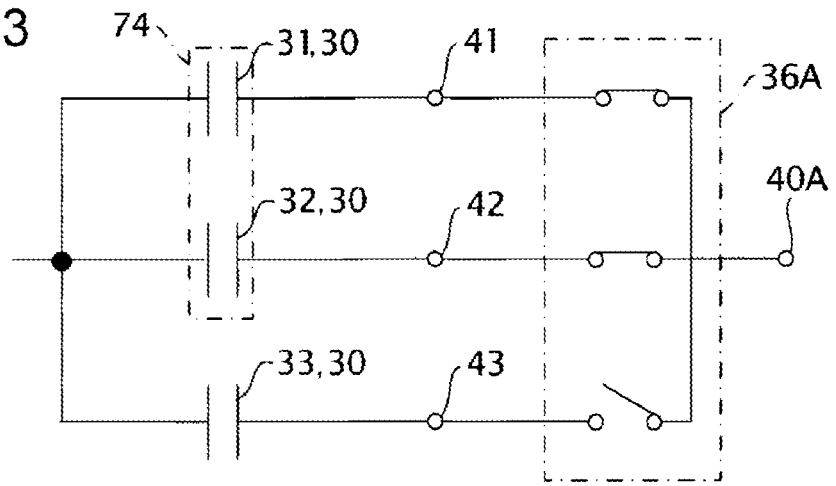
FIG. 23 is a circuit diagram showing an operation of a selector circuit according to a second modification example.
Figure 24:
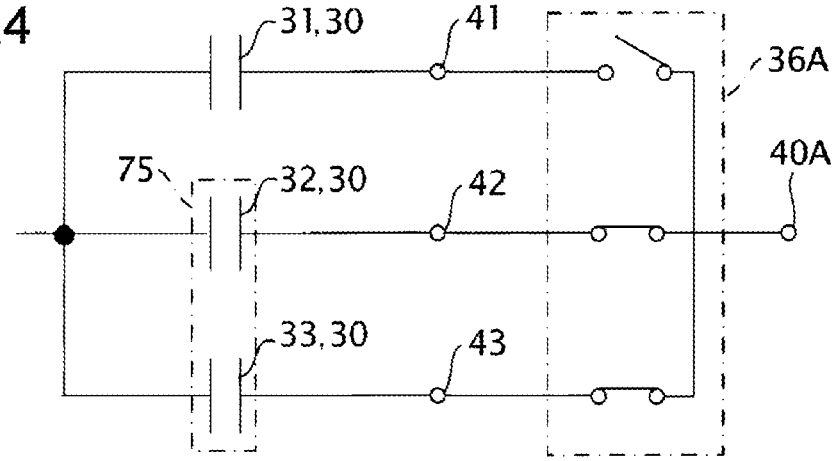
FIG. 24 is a circuit diagram showing the operation of the selector circuit according to the second modification example.
Figure 25:
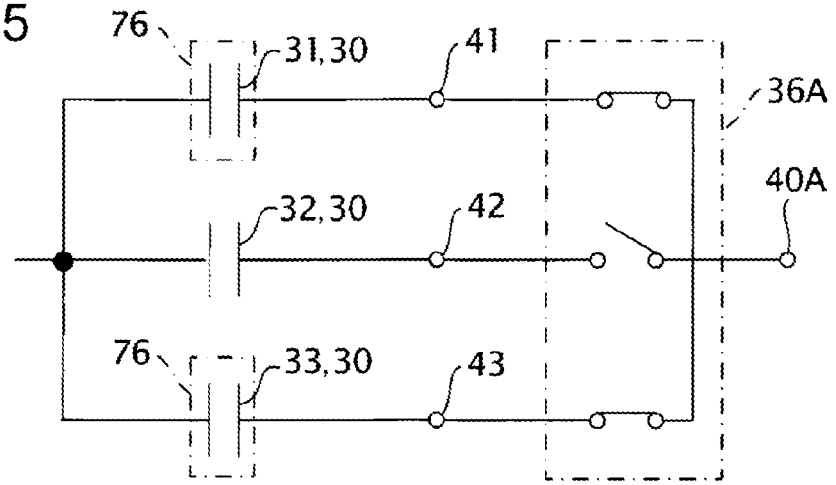
FIG. 25 is a circuit diagram showing the operation of the selector circuit according to the second modification example.

Next, a storage amount detection device 20A according to a second modification example will be described. FIGS. 23 to 25 are schematic diagrams of a selector circuit 63A of the storage amount detection device 20A according to the second modification example. The difference between the storage amount detection device according to the second modification example and the storage amount detection device 20A according to the first embodiment is that an operation of the selector circuit 36A is different.

The selector circuit 36A of the storage amount detection device 20A according to the second modification example switches whether or not to electrically couple the output terminal 40A to at least two of the input terminals 41 to 43. As shown in FIG. 23, the selector circuit 36A can switch to a state in which the input terminal 41 is electrically coupled to the output terminal 40A and the input terminal 42 is electrically coupled to the output terminal 40A. As shown in FIG. 24, the selector circuit 36A can switch to a state in which the input terminal 42 is electrically coupled to the output terminal 40A and the input terminal 43 is electrically coupled to the output terminal 40A. As shown in FIG. 25, the selector circuit 36A can switch to a state in which the input terminal 41 is electrically coupled to the output terminal 40A and the input terminal 42 is electrically coupled to the output terminal 40A.

In the storage amount detection device 20A according to the second modification example, in a state in which the input terminal 41 and the input terminal 42 are coupled to the output terminal 40A, a capacitor 74 is configured to include the reception electrode 31 and the reception electrode 32 as the reception electrodes. When the output voltage by the capacitor 74 exceeds the threshold value $V_{th}$, the detection circuit 63 determines that the liquid level L exists in the liquid level range LV1 or the liquid level range LV2.

In the storage amount detection device 20A, in a state in which the input terminal 42 and the input terminal 43 are coupled to the output terminal 40A, a capacitor 75 is configured to include the reception electrode 32 and the reception electrode 33 as the reception electrodes. When the output voltage by the capacitor 75 exceeds the threshold value $V_th$, the detection circuit 63 determines that the liquid level L exists in the liquid level range LV2 or the liquid level range LV3.

In the storage amount detection device 20A, in a state in which the input terminal 41 and the input terminal 43 are coupled to the output terminal 40A, a capacitor 76 is configured to include the reception electrode 31 and the reception electrode 33 as the reception electrodes. When the output voltage by the capacitor 76 exceeds the threshold value $V_{th}$, the detection circuit 63 determines that the liquid level L exists in the liquid level range LV1 or the liquid level range LV3.

The storage amount detection device 20A according to the second modification example also has the same effect as in the storage amount detection device 20A of the first embodiment.

Next, a liquid discharge device 1B according to a second embodiment will be described with reference to FIGS. 26 and 27. In the description of the second embodiment, the same description as in the above-described embodiment will not be repeated.

Figure 26:
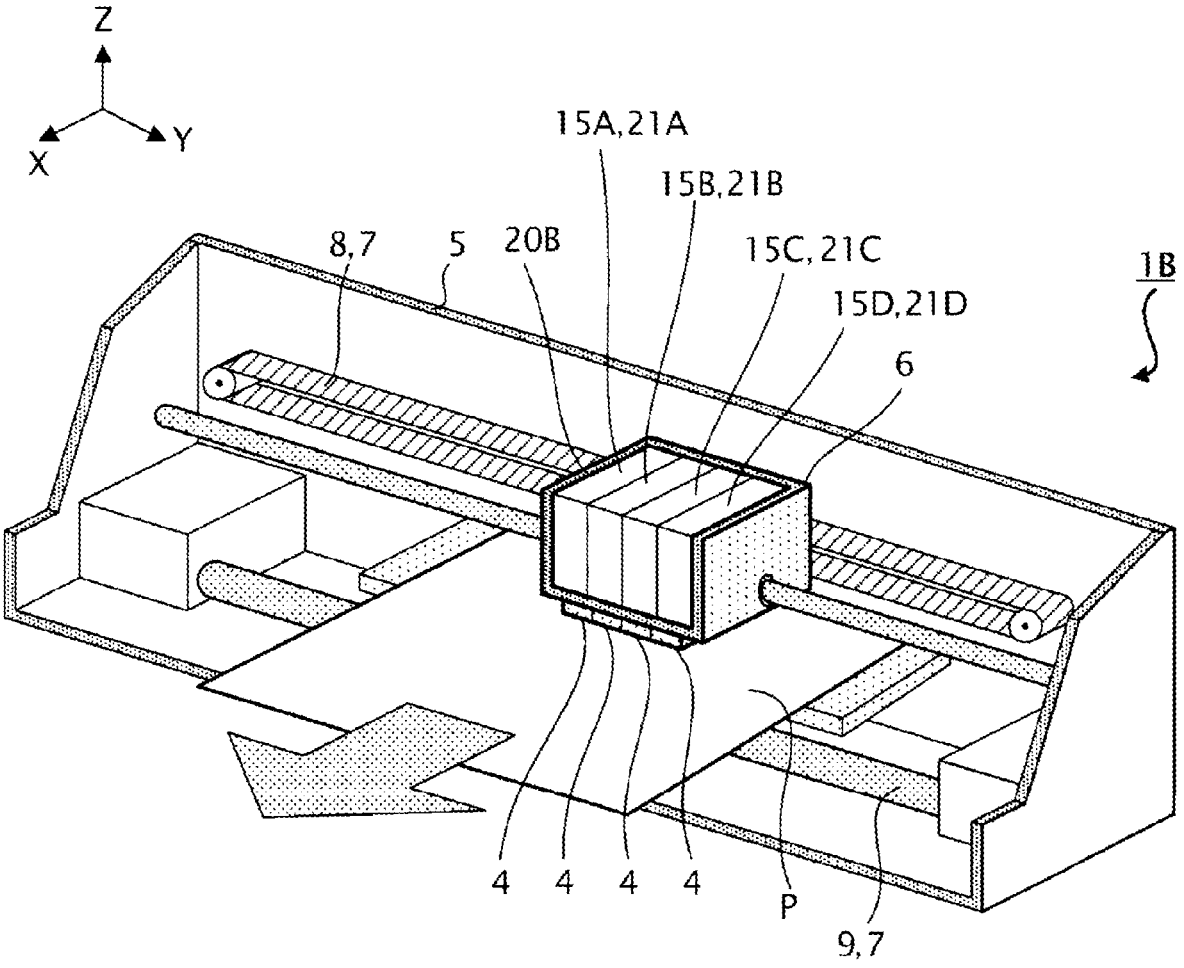
FIG. 26 is a schematic diagram of a liquid discharge device according to a second embodiment.

FIG. 26 is a schematic diagram of the liquid discharge device 1B according to the second embodiment. FIG. 27 is a schematic diagram of a storage amount detection device 20B according to the second embodiment. The liquid discharge device 1B includes a storage amount detection device 20B. The liquid discharge device 1B is a serial-type ink jet printer. The liquid discharge device 1B includes a carriage 6 that can reciprocate. The carriage 6 stores four ink cartridges 15A to 15D that one-to-one correspond with four colors of ink. The carriage 6 is provided with respective discharge sections 4 for the four ink cartridges 15A to 15D.

The ink cartridge 15A includes a storage section 21A that stores yellow ink 2. The ink cartridge 15B includes a storage section 21B that stores magenta ink 2. The ink cartridge 15C includes a storage section 21C that stores cyan ink 2. The ink cartridge 15D includes a storage section 21D that stores black ink 2.

Figure 27:
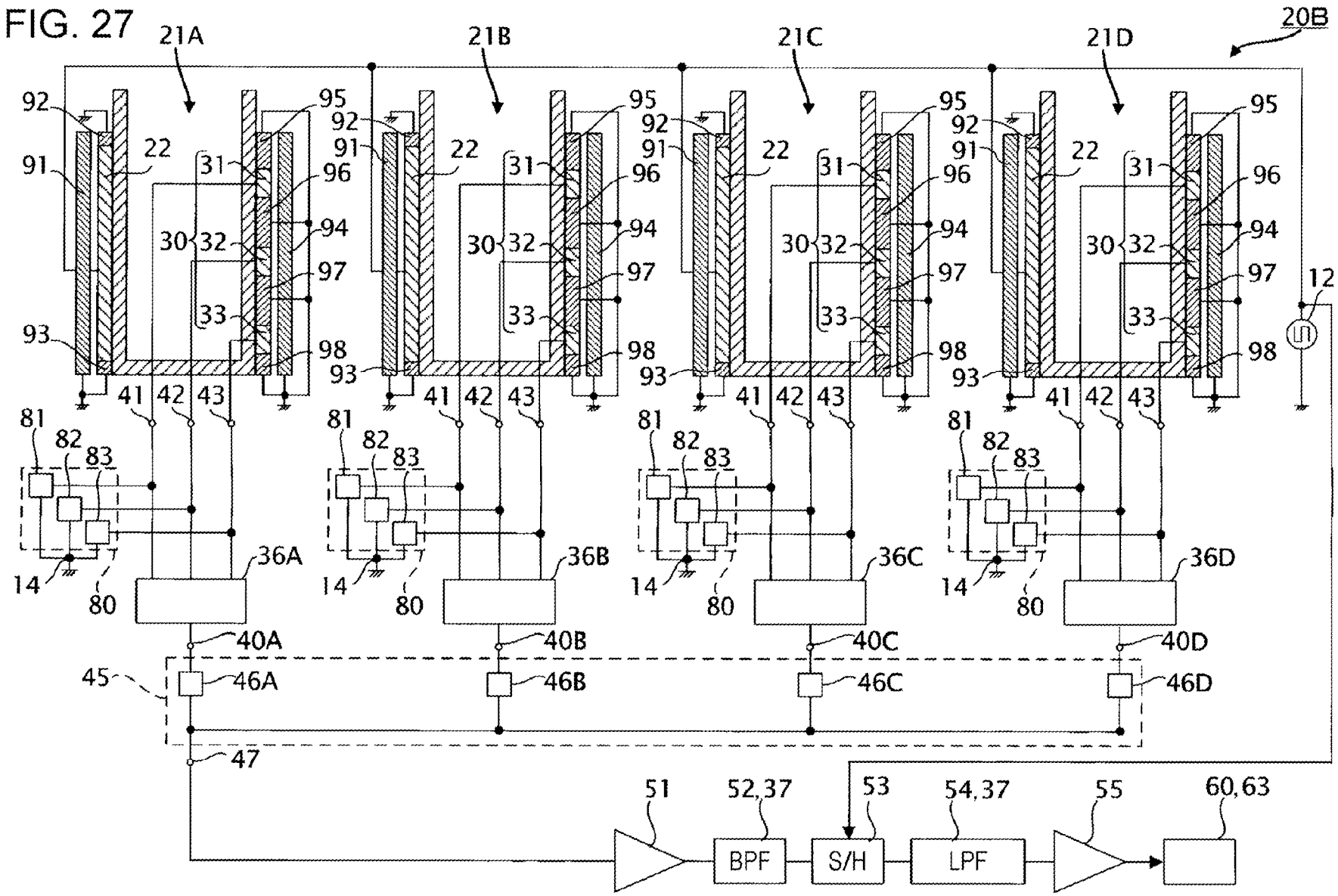
FIG. 27 is a schematic diagram of a storage amount detection device according to the second embodiment.

The storage amount detection device 20B shown in FIG. 27 is different from the storage amount detection device 20A according to the first embodiment in that the storage amount detection device 20B includes a plurality of storage sections 21A to 21D and a storage section selection circuit 45. The storage sections 21A to 21D have the same configuration as the storage section 21A of the first embodiment. The four storage sections 21A to 21D are provided with selector circuits 36A to 36D, respectively. The selector circuits 36A to 36D have output terminals 40A to 40D, respectively. The selector circuits 36B to 36D have the same configuration as the selector circuit 36A according to the above-described embodiment, and the output terminals 40B to 40D have the same configuration as the output terminal 40A according to the above-described embodiment.

The storage section selection circuit 45 includes a plurality of switch circuits 46A to 46D. The output terminal 47 of the storage section selection circuit 45 is electrically coupled to a buffer circuit 51 at a subsequent stage.

The storage section selection circuit 45 switches whether or not to couple the output terminal 47 to one of the plurality of selector circuits 36A to 36D. The switch circuit 46A switches whether or not to electrically couple the selector circuit 36A to the output terminal 47. The switch circuit 46A switches whether or not to electrically couple the selector circuit 36A to the output terminal 47. The switch circuit 46B switches whether or not to electrically couple the selector circuit 36B to the output terminal 47. The switch circuit 46C switches whether or not to electrically couple the selector circuit 36C to the output terminal 47. The switch circuit 46D switches whether or not to electrically couple the selector circuit 36D to the output terminal 47.

The control section 60 outputs a command signal indicating ON/OFF of the switch circuits 46A to 46D. The command signal is input to the storage section selection circuit 45. The storage section selection circuit 45 switches the switch circuits 46A to 46D based on the storage section selection signal. When detecting the liquid level L of the ink 2 stored in the storage section 21A, the storage section selection circuit 45 performs switch ON of the switch circuit 46A and electrically couples the selector circuit 36A to the output terminal 47. In this case, the storage section selection circuit 45 performs switch OFF on the remaining selector circuits 36B to 38D, and electrically disconnects the selector circuits 36B to 36D from the output terminal 47. Therefore, only the selector circuit 36A of the selector circuits 36A to 36D is electrically coupled to the output terminal 47.

Similarly, when detecting the liquid level L of the ink 2 stored in the storage section 21B, the storage section selection circuit 45 electrically couples the selector circuit 36B to the output terminal 47, and electrically disconnects the selector circuits 36A, 36C, and 36D from the output terminal 47.

When detecting the liquid level L of the ink 2 stored in the storage section 21C, the storage section selection circuit 45 electrically couples the selector circuit 36C to the output terminal 47, and electrically disconnects the selector circuits 36A, 36B, and 36D from the output terminal 47.

When detecting the liquid level L of the ink 2 stored in the storage section 21D, the storage section selection circuit 45 electrically couples the selector circuit 36D to the output terminal 47, and electrically disconnects the selector circuits 36A, 36B, and 36C from the output terminal 47.

According to the storage amount detection device 20B according to the second embodiment, the storage section selection circuit 45 is provided, so that it is possible to switch whether or not couple the output terminal 47 to one of the plurality of selector circuits 36A to 36D. In the storage amount detection device 20B, it is not necessary to provide respective detection circuits for the plurality of storage sections 21A to 21D, so that the circuit substrate can be miniaturized. In the storage amount detection device 20B, it is not necessary to perform correction for suppressing variation in circuit characteristic occurring when a plurality of detection circuits are used, so that the circuit substrate can be miniaturized and the detection accuracy of the storage amount can be improved.

Next, a storage amount detection device 20C according to a third modification example will be described with reference to FIGS. 28 and 29. The difference between the storage amount detection device according to the third modification example and the storage amount detection device 20A according to the first embodiment is that the reception electrode 30 includes four reception electrodes 31 to 34. The selector circuit 36A includes an input terminal 44 that is electrically coupled to the reception electrode 34. The reception electrode 34 is disposed at a lower height position than the reception electrodes 31 to 33.

Figure 28:
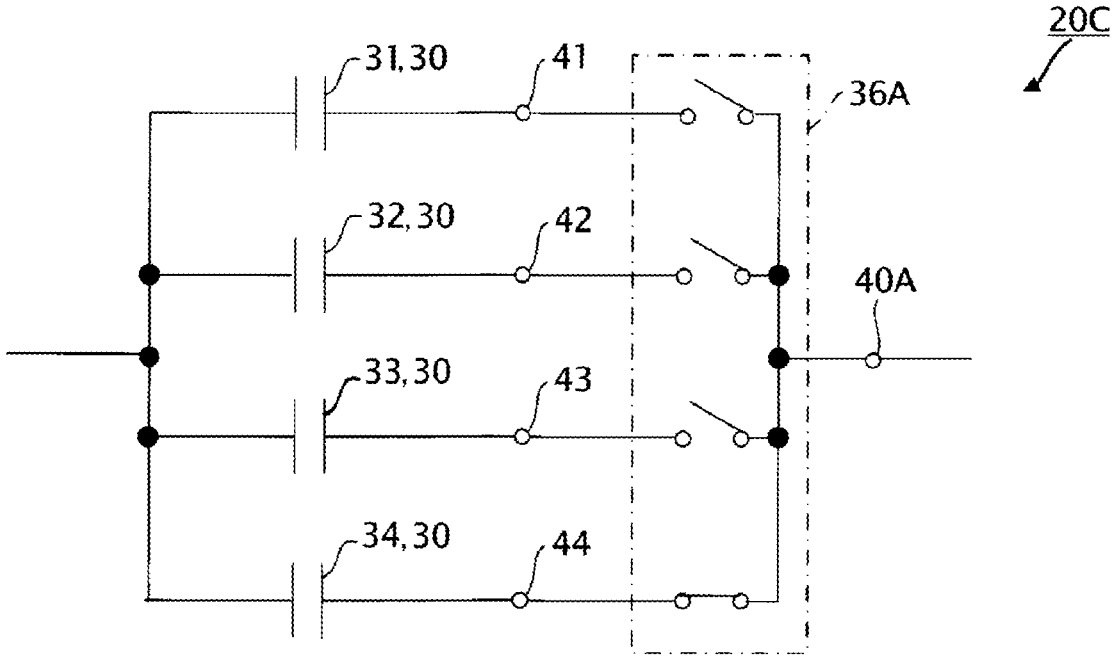
FIG. 28 is a circuit diagram showing an operation of a selector circuit according to a third modification example.

As shown in FIG. 28, the selector circuit 36A of the storage amount detection device 20C switches whether or not to electrically couple at least one of the input terminals 41 to 44 of the input terminals 41 to 44 to the output terminal 40A. When the reception electrode 34 is selected to detect the liquid level L, the selector circuit 36A electrically couples the output terminal 40A to the reception electrode 34, and electrically disconnects the output terminal 40A from the reception electrodes 31 to 33.

The detection circuit 63 determines whether or not the storage amount of the ink 2 is equal to or larger than a fourth amount based on the output from the output terminal 40A in a state in which the reception electrode 34 is coupled. The fourth amount is less than the third amount.

The selector circuit 36A of the storage amount detection device 20C can switch whether or not to electrically couple at least two of the input terminals 41 to 44 of the input terminals 41 to 44 to the output terminal 40A. The selector circuit 36A can electrically couple the input terminals 43 and 44 to the output terminal 40A, and can electrically disconnect the input terminals 41 and 43 from the output terminal 40A.

Figure 29:
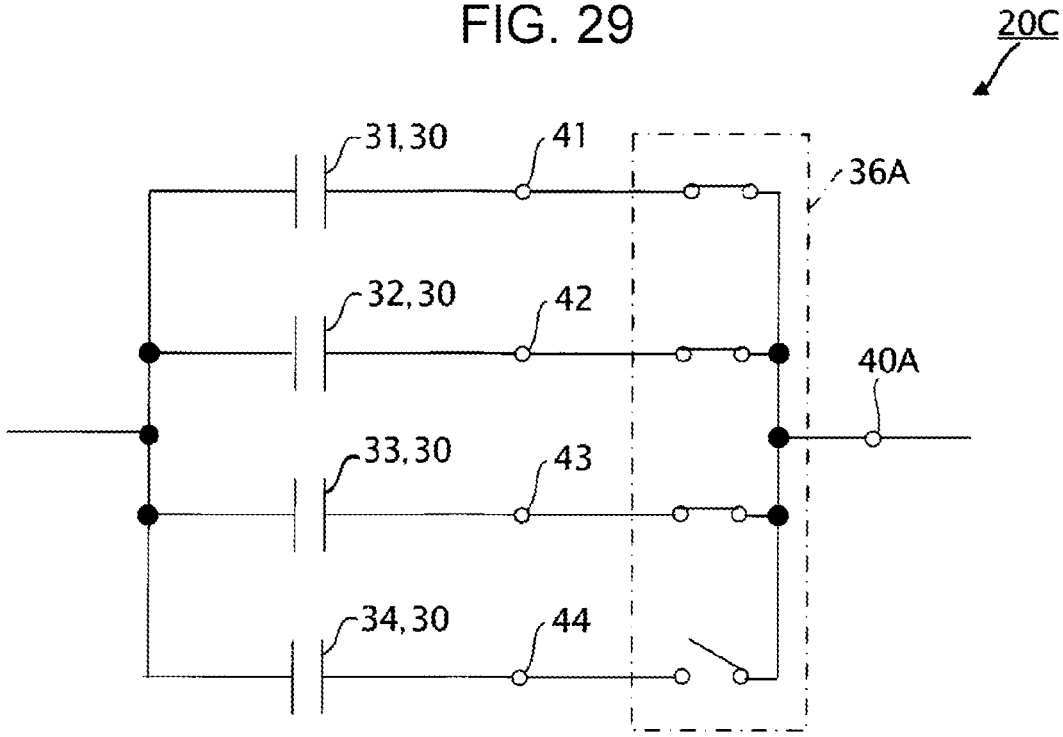
FIG. 29 is a circuit diagram showing the operation of the selector circuit according to the third modification example.

As shown in FIG. 29, the selector circuit 36A of the storage amount detection device 20C switches whether or not to electrically couple at least two of the input terminals 41 to 44 of the input terminals 41 to 44 to the output terminal 40A. The selector circuit 36A electrically couples the input terminals 41 to 43 to the output terminal 40A, and electrically disconnects the input terminal 44 from the output terminal 40A. The selector circuit 36A electrically disconnects only one of the input terminals 41 to 44 from the output terminal 40A.

The selector circuit 36A may electrically couple two input terminals 41 to 44 of the plurality of input terminals 41 to 44 to the output terminal 40A, and may electrically disconnect the two remaining input terminals 41 to 44 from the output terminal 40A. For example, the selector circuit 36A can electrically couple the input terminals 43 and 44 to the output terminal 40A and can electrically disconnect the remaining input terminals 41 and 42 from the output terminal 40A.

Figure 30:
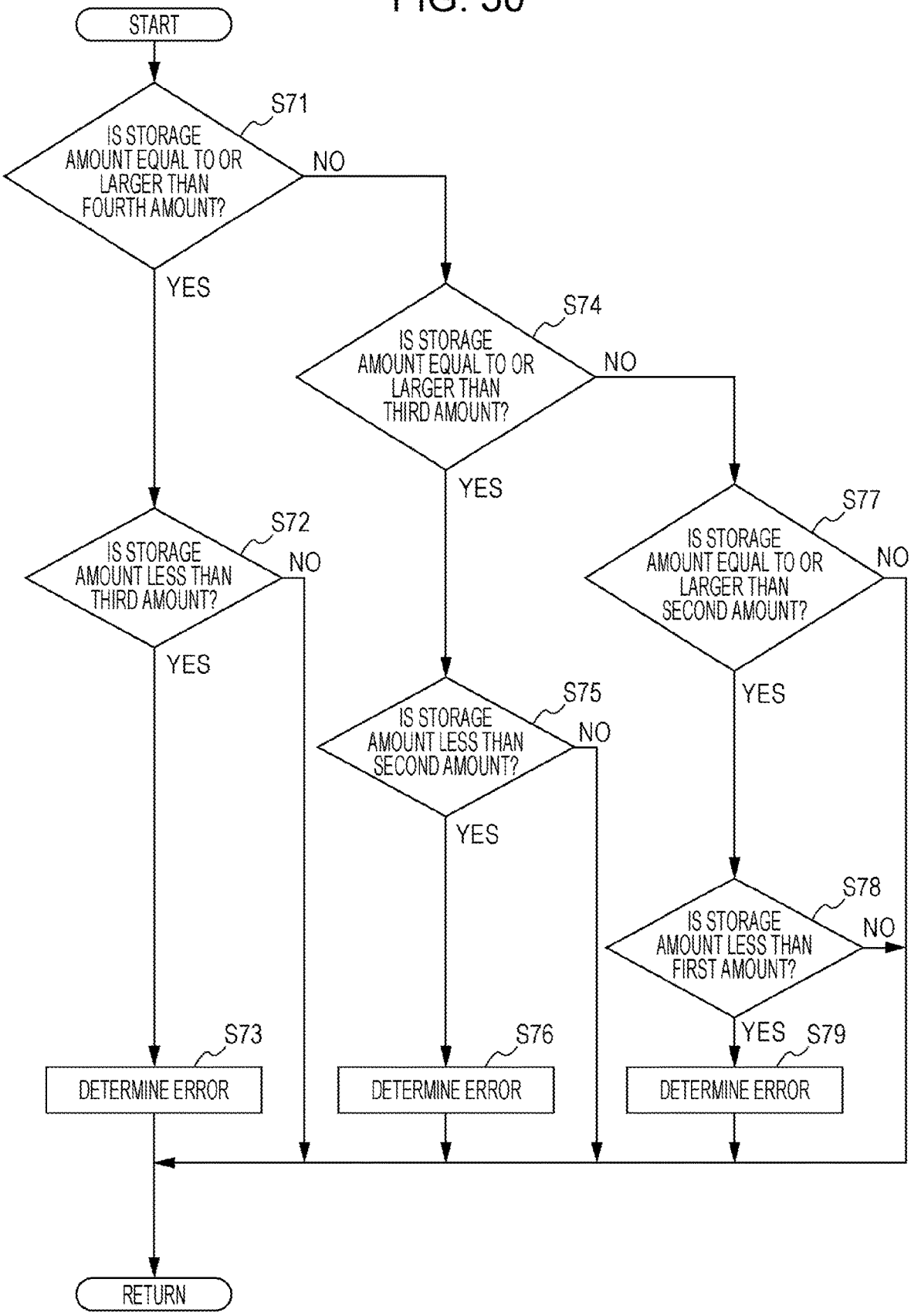
FIG. 30 is a flowchart showing an error determination procedure in a detection circuit according to the third modification example.

Next, with reference to FIG. 30, error determination in the storage amount detection device 20C according to the third modification example will be described. FIG. 30 is a flowchart showing the error determination procedure in the detection circuit 63 of the storage amount detection device 20C. In the storage amount detection device 20C, the detection of the liquid level L is performed using the reception electrode disposed at a low position, and, sequentially, detection of the liquid level L is performed using the reception electrode disposed at a higher position. In the storage amount detection device 20C, the detection of the liquid level L is performed in order of the reception electrode 34, the reception electrode 33, the reception electrode 32, and the reception electrode 31.

As shown in FIG. 30, first, in step S71, the detection circuit 63 determines whether or not the storage amount of the ink 2 is equal to or larger than the fourth amount based on the output from the output terminal 40A in the state in which the reception electrode 34 is electrically coupled. When the storage amount is equal to or larger than the fourth amount, the process proceeds to step S42, and, when the storage amount is not equal to or larger than the fourth amount, it is determined that the storage amount is less than the fourth amount, and the process proceeds to step S74.

In step S72, the detection circuit 63 determines whether or not the storage amount of the ink 2 is less than the third amount based on the electric signal output from the output terminal 40A in a state in which the reception electrodes 31 to 33 are coupled. In the state in which the reception electrodes 31 to 33 are electrically coupled to the output terminal 40A, the reception electrode 34 is electrically disconnected from the output terminal 40A. When the liquid level L is detected by the reception electrodes 31 to 33, the detection circuit 63 determines that the storage amount is equal to or larger than the third amount. When the liquid level L is not detected by the reception electrodes 31 to 33, the detection circuit 63 determines that the storage amount is less than the third amount.

When the storage amount is less than the third amount, the process proceeds to step S73 and the detection circuit 63 determines that the detection of the storage amount is error. The case where the process proceeds to step S73 is a case where it is determined that the storage amount is equal to or larger than the fourth amount and it is determined that the storage amount is less than the third amount, so that the detection of the storage amount is determined to be an error. When the storage amount is equal to or larger than the third amount, the detection circuit 63 ends the process here.

In step S74, the detection circuit 63 determines whether or not the storage amount of the ink 2 is equal to or larger than the third amount based on the electric signal output from the output terminal 40A in the state in which the reception electrode 33 is coupled. In the state in which the reception electrode 33 is electrically coupled to the output terminal 40A, the reception electrodes 31, 32, and 34 are electrically disconnected from the output terminal 40A. The detection circuit 63 proceeds to step S75 when the storage amount is equal to or larger than the third amount, and proceeds to step S77 when the storage amount is not equal to or larger than the third amount.

In step S75, the detection circuit 63 determines whether or not the storage amount of the ink 2 is less than the second amount based on the electric signal output from the output terminal 40A in the state in which the reception electrodes 31 and 32 are coupled. In the state in which the reception electrodes 31 and 32 are electrically coupled to the output terminal 40A, the reception electrodes 33 and 34 are electrically disconnected from the output terminal 40A. When the liquid level L is detected by the reception electrodes 31 and 32, the detection circuit 63 determines that the storage amount is equal to or larger than the second amount. When the liquid level L is not detected by the reception electrodes 31 and 32, the detection circuit 63 determines that the storage amount is less than the second amount.

When the storage amount is less than the second amount, the detection circuit 63 proceeds to step S76 and determines that the detection of the storage amount is error. The case where the process proceeds to step S76 is a case where it is determined that the storage amount is equal to or larger than the third amount and the storage amount is less than the second amount, so that the detection of the storage amount is determined to be an error. When the storage amount is equal to or larger than the second amount, the detection circuit 63 ends the process here.

In step S77, the detection circuit 63 determines whether or not the storage amount of the ink 2 is equal to or larger than the second amount based on the electric signal output from the output terminal 40A in the state in which the reception electrode 32 is coupled. In the state in which the reception electrode 32 is electrically coupled to the output terminal 40A, the reception electrodes 31, 33, and 34 are electrically disconnected from the output terminal 40A. When the storage amount is equal to or larger than the second amount, the process proceeds to step S78, and, when the storage amount is not equal to or larger than the second amount, the detection circuit 63 ends the process here.

In step S75, the detection circuit 63 determines whether or not the storage amount of the ink 2 is less than the first amount based on the electric signal output from the output terminal 40A in the state in which the reception electrode 31 is coupled. In the state in which the reception electrode 31 is electrically coupled to the output terminal 40A, the reception electrodes 32 to 34 are electrically disconnected from the output terminal 40A. When the liquid level L is detected by the reception electrode 31, the detection circuit 63 determines that the storage amount is equal to or larger than the first amount. When the liquid level L is not detected by the reception electrode 31, the detection circuit 63 determines that the storage amount is less than the first amount.

When the storage amount is less than the first amount, the detection circuit 63 proceeds to step S79 and determines that the detected result of the storage amount is error. The case where the process proceeds to step S78 is a case where it is determined that the storage amount is equal to or larger than the second amount and the storage amount is less than the first amount, so that the detection result of the storage amount is determined to be an error. When the storage amount is equal to or larger than the first amount, the detection circuit 63 ends the process here.

According to the storage amount detection device 20C according to the third modification example, the liquid level L can be detected by electrically coupling the plurality of reception electrodes 31 to 34 to the output terminal 40A by the selector circuit 36A. The liquid level L is detected by coupling the plurality of reception electrodes 31 to 34 and it is determined whether or not the detection result of the storage amount is error. Therefore, it is not necessary to perform measurement of the liquid level L for each of the reception electrodes 31 to 34. Therefore, the error determination can be rapidly performed, and the increase in the processing load in the detection circuit 63 is suppressed.

Next, a relationship between the output voltage $V_{out}$ of the reception electrodes 31 to 33 and the detection result of the storage amount will be described with reference to FIG. 31. FIG. 31 is a table showing the relationship between the output voltage $V_{out}$ and the detection result. FIG. 31 shows whether the detection result of the storage amount in the storage amount detection device 20A including the three reception electrodes 31 to 33 is normal or error. As shown in FIG. 31, "H" indicates a case where the output voltage $V_{out}$ is equal to or larger than the threshold value $V_{th}$, and "L" indicates a case where the output voltage $V_{out}$ is less than the threshold value $V_{th}$, and "H/L" indicates a case of "H" or "L".

In case 1, all the output voltages $V_{out}$ of the reception electrodes 31 to 33 are "H", so that the detection circuit 63 determines that the detection result of the storage amount is normal. In case 1, the detection circuit 63 determines that the storage amount is equal to or larger than the first amount as the detection result of the storage amount. In case 2, the output voltage $V_{out}$ of the reception electrode 31 is "H", the output voltage $V_{out}$ of the reception electrode 32 is "L", so that the detection circuit 63 determines that the detection result of the storage amount is error regardless of the output voltage $V_{out}$ of the reception electrode 33. In case 3, the output voltage $V_{out}$ of the reception electrode 31 is "H", the output voltage $V_{out}$ of the reception electrode 32 is "H", and the output voltage $V_{out}$ of the reception electrode 33 is "L", so that the detection circuit 63 determines that the detection result of the storage amount is error.

In case 4, the output voltage $V_{out}$ of the reception electrode 31 is "L", the output voltage $V_{out}$ of the reception electrode 32 is "H/L", and the output voltage $V_{out}$ of the reception electrode 33 is "H", so that the detection circuit 63 determines that the detection result of the storage amount is normal. In case 4, when the output voltage $V_{out}$ of the reception electrode 32 is "H", the detection circuit 63 determines that the storage amount is equal to or larger than the second amount as the detection result of the storage amount. In case 4, when the output voltage $V_{out}$ of the reception electrode 32 is "L", the detection circuit 63 determines that the storage amount is equal to or larger than the third amount as the detection result of the storage amount. In case 5, the output voltage $V_{out}$ of the reception electrode 31 is "L", the output voltage $V_{out}$ of the reception electrode 32 is "H", the reception electrode 33 is "L", so that the detection circuit. 63 determines that the detection result of the storage amount is error. In case 6, the output voltage $V_{out}$ of the reception electrode 31 is "L", the output voltage $V_{out}$ of the reception electrode 32 is "L", and the output voltage $V_{out}$ of the reception electrode 33 is "L", so that the detection circuit 63 determines that the detection result of the storage amount is normal. In case 6, the detection circuit 63 determines that the storage amount is less than the third amount as the detection result of the storage amount.

Next, with reference to FIG. 32, the relationship between the output voltages $V_{out}$ of the reception electrodes 31 to 34 and the detection result of the storage amount will be described. FIG. 32 is a table showing the relationship between the output voltage $V_{out}$ and the detection result. FIG. 32 shows whether the detection result of the storage amount in the storage amount detection device 20C including the four reception electrodes 31 to 34 shown in FIGS. 28 and 29 is normal or error.

FIG. 32 illustrates a case where two or more of the four reception electrodes 31 to 34 are electrically coupled to the output terminal 40A to perform error determination. FIG. 32 illustrates a part of the case where two or more reception electrodes 31 to 34 are coupled to the output terminal 40A. In the case shown in FIG. 32, as shown in FIG. 30, measurement is performed first using the reception electrode 34 disposed at the low position, and, subsequently, measurement is performed using the reception electrode 33, the reception electrode 32, and the reception electrode 31 disposed at the higher positions.

In cases 1 to 3, the storage amount detection device 20C first performs measurement using the reception electrode 34, and, thereafter, performs measurement using the reception electrodes 31 to 33. In cases 1 to 3, the detection circuit 63 performs the error determination based on an output in the state in which the reception electrodes 31 to 33 are simultaneously coupled to the output terminal 40A. In case 1, the output voltage $V_{out}$ of the reception electrode 34 is "L" and the output voltages $V_{out}$ of the reception electrodes 31 to 33 are "L", so that the detection circuit 63 determines that the detection result of the storage amount is normal. In case 1, the detection circuit 63 determines that the storage amount is less than the fourth amount as the detection result of the storage amount. In case 2, the output voltage $V_{out}$ of the reception electrode 34 is "L" and the output voltages $V_{out}$ of the reception electrodes 31 to 33 are "H", so that the detection circuit 63 determines that the detection result of the storage amount is error. In case 3, the output voltage $V_{out}$ of the reception electrode 34 is "H" and the output voltages $V_{out}$ of the reception electrodes 31 to 33 are "L", so that the detection circuit 63 determines that the detection result of the storage amount is normal. In case 3, the detection circuit 63 determines that the storage amount is equal to or larger than the fourth amount as the detection result of the storage amount.

In cases 4 to 6, the storage amount detection device 20C first performs the measurement using the reception electrodes 33 and 34, and, thereafter, performs the measurement using the reception electrodes 31 and 32. In the measurement using the reception electrodes 33 and 34, the detection circuit 63 performs the error determination based on an output in a state in which the reception electrodes 33 and 34 are simultaneously coupled to the output terminal 40A. In the measurement using the reception electrodes 31 and 32, the detection circuit 63 performs the error determination based on an output in a state in which the reception electrodes 31 and 32 are simultaneously coupled to the output terminal 40A.

In case 4, the output voltages $V_{out}$ of the reception electrodes 33 and 34 are "L" and the output voltages $V_{out}$ of the reception electrodes 31 and 32 are "L", so that the detection circuit 63 determines that the detection result of the storage amount is normal. In case 4, the detection circuit 63 determines that the storage amount is less than the fourth amount as the detection result of the storage amount. In case 5, the output voltages $V_{out}$ of the reception electrodes 33 and 34 are "L" and the output voltages $V_{out}$ of the reception electrodes 31 and 32 are "H", so that the detection circuit 63 determines that the detection result of the storage amount is error. In case 6, the output voltages $V_{out}$ of the reception electrodes 33 and 34 are "H" and the output voltages $V_{out}$ of the reception electrodes 31 and 32 are "L", so that the detection circuit 63 determines that the detection result of the storage amount is normal. In case 6, the detection circuit 63 determines that the storage amount is equal to or larger than the third amount or equal to or larger than the fourth amount, as the detection result of the storage amount.

In cases 7 to 9, the storage amount detection device 20C first performs the measurement using the reception electrodes 32 to 34, and, thereafter, performs the measurement using the reception electrode 31. In the measurement using the reception electrodes 32 to 34, the detection circuit 63 performs the error determination based on an output in a state in which the reception electrodes 32 to 34 are simultaneously coupled to the output terminal 40A.

In case 7, the output voltages $V_{out}$ of the reception electrodes 32 to 34 are "L" and the output voltage $V_{out}$ of the reception electrode 31 is "H", so that the detection circuit 63 determines that the detection result of the storage amount is error. In case 8, the output voltages $V_{out}$ of the reception electrodes 32 to 34 are "L" and the output voltage $V_{out}$ of the reception electrode 31 is "L", so that the detection circuit 63 determines that the detection result of the storage amount is normal. In case 8, the detection circuit 63 determines that the storage amount is less than the fourth amount as the detection result of the storage amount. In case 9, the output voltages $V_{out}$ of the reception electrodes 32 to 34 are "H" and the output voltage $V_{out}$ of the reception electrode 31 is "H/L", so that the detection circuit 63 determines that the detection result of the storage amount is normal. In case 9, when the output voltage $V_{out}$ of the reception electrode 31 is "H", the detection circuit 63 determines that the storage amount is equal to or larger than the first amount as the detection result of the storage amount. In case 9, when the output voltage $V_{out}$ of the reception electrode 31 is "L", the detection circuit 63 determines that the storage amount is equal to or less than the second amount as the detection result of the storage amount.

According to the storage amount detection device 20C, it is possible to determine whether or not the detection result of the storage amount is error by using the output voltage $V_{out}$ in the state in which the plurality of reception electrodes 31 to 34 are coupled to the output terminal 40A. Therefore, it is not necessary to perform the measurement by individually switching the reception electrodes 31 to 34 for the reception electrodes 31 to 34. According to the storage amount detection device 20C, an increase in processing loads of the control section 60 is suppressed when performing an error determination.

The above-described embodiments merely show typical aspects of the present disclosure, and the present disclosure is not limited to the above-described embodiments, and various modifications and additions are possible in a scope that does not deviate from the gist of the present disclosure.

In the above-described embodiments, the storage amount detection device 20A is configured to include three reception electrodes 31 to 33, but the storage amount detection device 20A is not limited to the configuration including the three reception electrodes 30. The storage amount detection device 20A may be configured to include one reception electrode 30, may be configured to include two reception electrodes 30, or may be configured to include four or more reception electrodes 30.

In the above-described embodiments, the reception electrodes 31 to 33 are configured to be disposed at height positions different from each other, but a plurality of reception electrodes 31 to 33 may be configured to be disposed at the same height position.

In the above-described embodiments, the ink 2 is exemplified as an object stored in the storage sections 21A to 21D. However, the object stored in the storage sections 21A to 21D may be another liquid, a solid, or a gas.

In the above-described embodiments, the liquid discharge devices 1A and 1B in which the discharge section 4 and the storage sections 21A to 21D are mounted on the carriage 6 are described. However, the liquid discharge devices 1A and 1B are not limited thereto, and the discharge section 4 and the storage section 21A may not be mounted on the carriage 6. Further, the liquid discharge devices 1A and 1B are not limited to the serial-type ink jet printer, and may be other printing devices.

In the above-described embodiments, the storage sections 21A to 21D are exemplified as the ink cartridges of the liquid discharge devices 1A and 1B. However, the storage sections 21A to 21D may be ink tanks for storing the ink 2 used in other printing devices. The storage sections 21A to 21D may be mounted on an ink server that supplies the ink 2 to the printing device.

What is claimed is:

1. A liquid discharge device comprising:

a discharge section that discharges a liquid;

a storage section that includes a first surface and a second surface separated from the first surface in a first direction, and is configured to store the liquid between the first surface and the second surface;

a transmission electrode that is provided on the first surface;

a reception electrode that is provided on the second surface;

a filter circuit that removes a predetermined frequency component from an electric signal supplied from the reception electrode; and a detection circuit that detects a storage amount of the liquid stored in the storage section based on an output from the filter circuit.

2. The liquid discharge device according to claim 1, wherein the filter circuit includes a low-pass filter circuit that removes a high frequency component from an input electric signal.

3. The liquid discharge device according to claim 1, wherein the filter circuit includes a bandpass filter circuit that passes a frequency component of a predetermined band in an input electric signal.

4. The liquid discharge device according to claim 1, further comprising:

an A/D converter that is coupled to a subsequent stage of the filter circuit, and converts an analog electric signal, which is an input electric signal, into a digital electric signal.

5. The liquid discharge device according to claim 1, further comprising:

an amplifier circuit that is coupled to a subsequent stage of the filter circuit, and amplifies an input electric signal.

6. The liquid discharge device according to claim 1, wherein the reception electrode is not shielded by a ground potential.

7. The liquid discharge device according to claim 1, wherein the reception electrode includes a first reception electrode, and a second reception electrode, the liquid discharge device further includes an output terminal, and a selector circuit that switches whether or not to electrically couple the output terminal to at least one of the first reception electrode and the second reception electrode, and the filter circuit is coupled to a subsequent stage of the selector circuit.

8. The liquid discharge device according to claim 1, wherein the liquid discharge device is a serial-type ink jet printing device.

9. The liquid discharge device according to claim 8, further comprising:

a carriage that is configured to reciprocate, wherein the carriage is provided with the discharge section and the storage section.

* * * * *